US009272551B2

(12) United States Patent
Takino et al.

(10) Patent No.: US 9,272,551 B2
(45) Date of Patent: Mar. 1, 2016

(54) LIQUID EJECTING APPARATUS WITH LIQUID EJECTING HEAD UNIT AND ROLLERS

(71) Applicant: Seiko Epson Corporation, Shinjuku-ku (JP)

(72) Inventors: Fumiya Takino, Shiojiri (JP); Taku Hirashima, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/645,241

(22) Filed: Mar. 11, 2015

(65) Prior Publication Data

US 2015/0273907 A1 Oct. 1, 2015

(30) Foreign Application Priority Data

Mar. 28, 2014 (JP) ..... 2014-069775

(51) Int. Cl.
*B41J 23/00* (2006.01)
*B41J 25/304* (2006.01)
*B41J 2/14* (2006.01)

(52) U.S. Cl.
CPC . *B41J 25/304* (2013.01); *B41J 2/14* (2013.01)

(58) Field of Classification Search
None
See application file for complete search history.

(56) References Cited

U.S. PATENT DOCUMENTS

| | | | | |
|---|---|---|---|---|
| 7,789,492 | B2 | 9/2010 | Akahane | |
| 8,210,647 | B2 | 7/2012 | Shimazu et al. | |
| 2004/0160475 | A1 * | 8/2004 | Satoh et al. | 347/36 |
| 2007/0008385 | A1 * | 1/2007 | Akahane | 347/65 |
| 2010/0128077 | A1 * | 5/2010 | Sugahara | 347/14 |
| 2015/0077473 | A1 * | 3/2015 | Wanibe et al. | 347/50 |

FOREIGN PATENT DOCUMENTS

| | | | |
|---|---|---|---|
| JP | 2001-310516 A | | 11/2001 |
| JP | 2004-277023 A | | 10/2004 |
| JP | 2007-001109 A | | 1/2007 |
| JP | 2007223196 A | * | 9/2007 |
| JP | 2009-262544 A | | 11/2009 |

* cited by examiner

*Primary Examiner* — Bradley Thies
(74) *Attorney, Agent, or Firm* — Kilpatrick Townsend & Stockton LLP

(57) ABSTRACT

A liquid ejecting apparatus includes: a liquid ejecting head unit which has liquid ejecting heads that eject liquid; an in-head roller which abuts against a landing surface of an ejecting medium; and a frame which pivotally supports the in-head roller. The liquid ejecting head unit is provided to be able to ascend and descend with respect to the frame. In the liquid ejecting head unit, at least two head rows, each of which includes the liquid ejecting heads and a void aligned in a reference direction intersecting a transporting direction of the ejecting medium, are arranged in the transporting direction. The in-head roller is disposed at a position where at least a part of the in-head roller faces the void, in a direction which is orthogonal to the landing surface.

19 Claims, 21 Drawing Sheets

LIQUID EJECTING APPARATUS WITH LIQUID EJECTING HEAD UNIT AND ROLLERS

CROSS REFERENCES TO RELATED APPLICATIONS

This application claims priority to Japanese Patent Application No. 2014-069775 filed on Mar. 28, 2014. The entire disclosure of Japanese Patent Application No. 2014-069775 is hereby incorporated herein by reference.

BACKGROUND

1. Technical Field

The present invention relates to a liquid ejecting apparatus and a liquid ejecting head unit which include a liquid ejecting head that ejects liquid from a nozzle opening, particularly to an ink jet type recording apparatus and an ink jet type recording head unit which eject ink as the liquid.

2. Related Art

A liquid ejecting apparatus which is represented by an ink jet type recording apparatus, such as an ink jet type printer or a plotter, is provided with a liquid ejecting head which can eject liquid, such as ink, which is stored in a cartridge or a tank.

In the liquid ejecting head which is used in the liquid ejecting apparatus, it is difficult to allow nozzle openings to have high density and a long shape as a single body because a yield of the liquid ejecting head deteriorates and a manufacturing cost increases. For this reason, a liquid ejecting head unit, which fixes the plurality of liquid ejecting heads to a common member and makes the plurality of liquid ejecting heads into a unit, is suggested.

In the liquid ejecting head unit, rollers are respectively provided on an upstream side and a downstream side of a transporting direction of the liquid ejecting head, and in a state where the rollers on both sides of the liquid ejecting head hold an ejecting medium, the liquid which is ejected from the liquid ejecting head unit lands on the ejecting medium.

At this time, when the rollers are provided at each position where the liquid ejecting head unit is nipped in the transporting direction, there is a concern that an interval between the two rollers widens, the ejecting medium which is held between the two rollers lifts up, and a landing position of the liquid on the ejecting medium is shifted.

For this reason, in JP-A-2009-262544, as the liquid ejecting head unit is provided with the plurality of liquid ejecting heads which is disposed in a zigzag shape, a plurality of spurs which is disposed alternately with the liquid ejecting heads, and a housing which supports the liquid ejecting heads and a rotation axis of the spurs, a distance between the spurs is shortened, and the ejecting medium is prevented from lifting up.

However, in a case where the plurality of liquid ejecting heads and the rollers are fixed to the liquid ejecting head unit together, when a liquid ejecting surface is wiped off by a blade made of rubber or the like, there is a problem that the blade comes into contact with the rollers.

In addition, it is possible to wipe off the liquid ejecting surface by making the blade relatively ascend and descend for each liquid ejecting head. However, there is a problem that it is required that the blade or the liquid ejecting head unit move in a complicated manner, and it takes time to wipe off the liquid ejecting surface.

In addition, there is a problem that a splash of the liquid which is generated when the liquid ejecting surface is wiped off by the blade is likely to be attached to the rollers, and the ejecting medium is contaminated as the liquid attached to the rollers is transferred to the ejecting medium.

In addition, the problem exists not only in the ink jet recording apparatus, and similarly, even in the liquid ejecting apparatus which ejects the liquid other than the ink.

SUMMARY

An advantage of some aspects of the invention is to provide a liquid ejecting apparatus and a liquid ejecting head unit which can prevent a landing position of liquid on a liquid ejecting medium from being shifted, which can easily perform maintenance of the liquid ejecting head unit during a short period of time, and can suppress contamination of an ejecting medium.

Aspect 1

According to this aspect of the invention, there is provided a liquid ejecting apparatus, including: a liquid ejecting head unit which has a plurality of liquid ejecting heads that ejects liquid; an in-head roller which abuts against a landing surface of an ejecting medium and presses the landing surface; and a frame which pivotally supports the in-head roller. The liquid ejecting head unit is provided to be able to ascend and descend in a direction which is orthogonal to the landing surface with respect to the frame. In the liquid ejecting head unit, at least two head rows, which are configured of the plurality of liquid ejecting heads aligned in parallel with a void in a reference direction which intersects a transporting direction of the ejecting medium, are formed in the transporting direction. The two head rows which are aligned in parallel in the transporting direction are disposed at a position where the void of one head row is overlapped with the liquid ejecting heads in the other head row in the transporting direction. The in-head roller is disposed at a position where at least a part of the in-head roller faces the void, in a direction which is orthogonal to the landing surface.

In this case, as the in-head roller is provided at the position which faces the void of the liquid ejecting head unit, it is possible to shorten a distance between the in-head rollers provided on both sides of the liquid ejecting head unit in the transporting direction, to prevent the ejecting medium which is held between the in-head rollers from lifting up, and to prevent a landing position of the liquid from being shifted. In addition, as the liquid ejecting head unit can ascend and descend with respect to the frame which pivotally supports the in-head unit, when the liquid ejecting head unit ascends and maintenance is performed, the in-head roller does not interfere, and it is possible to easily perform the maintenance during a short period of time. In addition, the liquid when performing the maintenance is unlikely to be attached to the in-head roller, and it is possible to suppress contamination of the ejecting medium due to the liquid attached to the in-head roller.

Aspect 2

In the liquid ejecting apparatus according to Aspect 1, in the liquid ejecting head unit, in a region which corresponds to the void of the head rows, a first accommodation portion, which has a recessed shape that is opened to the ejecting medium side, is preferably provided. At least a part of the in-head roller is preferably accommodated inside the first accommodation portion when the liquid ejecting head unit is at an ejecting position where the liquid is ejected on the ejecting medium. According to this, as the in-head roller is accommodated in the first accommodation portion, it is possible to make an interval between the liquid ejecting surface and the landing surface narrow, and to perform fast printing by preventing the landing position from being shifted.

Aspect 3

In the liquid ejecting apparatus according to Aspect 1 or 2, an out-head roller which abuts against the landing surface of the ejecting medium and presses the landing surface is preferably further provided. The out-head roller is preferably pivotally supported by the frame. The out-head roller is preferably disposed on an outer side of the liquid ejecting head unit in the transporting direction. According to this, as the out-head roller and the in-head roller are provided, it is possible to hold the ejecting medium at a plurality of locations in the reference direction, and to prevent the ejecting medium from lifting up in the reference direction.

Aspect 4

In the liquid ejecting apparatus according to Aspect 3, at least a part of the out-head roller and a part of the in-head roller are preferably disposed to face each other in an axial direction of a rotation axis. According to this, it is possible to provide the in-head roller and the out-head roller to be close to each other in the transporting direction, and to make a distance between the liquid ejecting head unit and the frame narrow in the transporting direction.

Aspect 5

In the liquid ejecting apparatus according to any of Aspects 1 to 3, the in-head roller is preferably pivotally supported by an arm which is provided to be rotatable in the frame. The arm preferably biases the in-head roller toward the landing surface side in a direction which is orthogonal to the landing surface as the arm is biased in a direction which is different from the direction which is orthogonal to the landing surface by a first bias unit. The out-head roller is preferably biased by a second bias member which performs biasing toward the landing surface side in a direction which is orthogonal to the landing surface. According to this, it is possible to reliably hold the ejecting medium by the rollers which bias the ejecting medium. In addition, since the in-head roller is biased via the arm, it is possible to make a space at which the in-head roller is disposed between the liquid ejecting head and the ejecting medium narrow. Therefore, it is possible to make a height of a liquid ejection apparatus in the direction which is orthogonal to the landing surface low. Furthermore, since a biasing direction of the first bias unit which biases the arm which pivotally supports the in-head roller is a direction which is different from a direction in which the in-head roller is biased and the ejecting medium is pressed down, it is possible to make the frame which pivotally supports the arm small in the transporting direction.

Aspect 6

In the liquid ejecting apparatus according to any of Aspects 1 to 5, when viewed from the direction which is orthogonal to the landing surface, the frame preferably has a circular structure which surrounds the liquid ejecting head unit. According to this, it is possible to improve rigidity of the frame and to make the frame small.

Aspect 7

In the liquid ejecting apparatus according to any of Aspects 1 to 6, the rotation axis of the in-head roller is preferably provided to face the liquid ejecting head unit in the direction which is orthogonal to the landing surface. According to this, since the in-head roller is much closer to the liquid ejecting head unit, it is possible to make the distance between the in-head rollers provided on both sides of the liquid ejecting head unit in the transporting direction much narrower, and to stabilize a posture of the ejecting medium.

Aspect 8

In the liquid ejecting apparatus according to any of Aspects 1 to 7, the liquid ejecting head preferably includes a wiring substrate having flexibility. The liquid ejecting head unit is preferably provided with a relay substrate to which the plurality of wiring substrates is connected. The relay substrate is preferably disposed so that a direction which includes the direction which is orthogonal to the landing surface and the reference direction becomes a surface direction. The wiring substrate of the liquid ejecting head which is disposed on one side of the transporting direction more than the relay substrate among the plurality of liquid ejecting heads is preferably connected to a first surface on one side of the transporting direction of the relay substrate. The wiring substrate of the liquid ejecting head which is disposed on the other side of the transporting direction more than the relay substrate among the plurality of liquid ejecting heads is preferably connected to a second surface on the other side of the transporting direction of the relay substrate. Connected parts, at which the wiring substrate and the relay substrate of each of the liquid ejecting heads which are adjacent to each other in the transporting direction are connected to each other, are preferably disposed so that some parts are overlapped with each other in the transporting direction. According to this, on both surfaces of the relay substrate, it is possible to easily perform connecting the wiring substrate. In addition, since the wiring substrate is connected to both surfaces of the relay substrate, it is possible to prevent the wiring substrates from interfering with each other, to connect the wiring substrate at a lower position which is the same as the positon of the relay substrate, and to make the relay substrate small. In addition, it is possible to adjust an amount of overlapping of the liquid ejecting heads which are adjacent to each other in the reference direction, and to suppress deterioration of a printing quality in a joint of the liquid ejecting heads which are adjacent to each other in the reference direction.

Aspect 9

In the liquid ejecting apparatus according to any of Aspects 1 to 8, in the liquid ejecting head unit, as two head rows are disposed to be shifted from each other in the reference direction, an interval between an end portion of one head row and an end portion of the other head row in the reference direction is preferably wider than the void. According to this, it is possible to suppress deterioration of the printing quality in the joint of the liquid ejecting heads which are adjacent to each other in the reference direction.

Aspect 10

In the liquid ejecting apparatus according to Aspect 9, the in-head roller is preferably disposed even at a position where at least a part thereof faces the interval in the direction which is orthogonal to the landing surface. According to this, it is possible to prevent both ends of the ejecting medium in the reference direction from lifting up.

Aspect 11

In the liquid ejecting apparatus according to Aspect 10, the plurality of in-head rollers is preferably provided to face the one interval. The number of the in-head rollers which face the one interval is preferably larger than the number of the in-head rollers which face the void. According to this, it is possible to further reliably prevent both ends of the ejecting medium in the reference direction from lifting up.

Aspect 12

In the liquid ejecting apparatus according to Aspect 10 or 11, the plurality of in-head rollers is preferably provided to face the one interval. The plurality of in-head rollers is provided to face the one void. In a direction of the rotation axis of the in-head roller, the interval of the plurality of in-head rollers which is provided to face the interval is preferably larger than the interval of the plurality of in-head rollers which is provided to face the void. According to this, it is possible to scatter a trace of the roller by the in-head roller provided in the void, and to suppress the trace of the roller.

Aspect 13

In the liquid ejecting apparatus according to Aspects 1 to 12, the plurality of liquid ejecting head units is preferably provided. The in-head roller which is provided corresponding to the void of each of the liquid ejecting head units is preferably disposed at a different position in an axial direction of the rotation axis. According to this, it is possible to scatter the trace of the roller by the in-head roller, and to suppress the trace of the roller.

Aspect 14

In the liquid ejecting apparatus according to Aspects 10 to 12, the plurality of liquid ejecting head units is preferably provided. The in-head roller which is provided corresponding to the interval of each of the liquid ejecting head units is preferably disposed at a different position in the axial direction of the rotation axis. According to this, it is possible to scatter the trace of the roller by the in-head roller, and to suppress the trace of the roller.

Aspect 15

In the liquid ejecting apparatus according to Aspect 14, the plurality of liquid ejecting head units is preferably provided. The in-head roller which is provided corresponding to the void of each of the liquid ejecting head units is preferably disposed at a different position in the axial direction of the rotation axis. The interval in the direction of the rotation axis of the in-head roller which is provided corresponding to the interval of each of the liquid ejecting head units is preferably wider than the interval in the axial direction of the rotation axis of the in-head roller which is provided corresponding to the void of each of the liquid ejecting head units. According to this, it is possible to scatter the trace of the roller by the in-head roller which is provided corresponding to the interval, and to suppress the trace of the roller.

Aspect 16

According to this aspect of the invention, there is provided a liquid ejecting head unit, in which at least two head rows which have liquid ejecting heads that eject liquid aligned in parallel with a void in a reference direction are formed in a direction which intersects the reference direction, in which the two head rows which are aligned in parallel in the direction which intersects the reference direction are positioned at a position where the void of one head row is overlapped with the liquid ejecting heads of the other head row in the direction which intersects the reference direction, and in which, in a region which corresponds to the void of the head row, a first accommodation portion, which has a recessed shape that is opened in a liquid ejecting direction, and which can accommodate an in-head roller that presses a landing surface of liquid on an ejecting medium inside thereof, is provided.

In this case, as the in-head roller is provided at a position which faces the void of the liquid ejecting head unit, it is possible to shorten a distance between the in-head rollers provided on both sides of the liquid ejecting head unit in the transporting direction, to prevent the ejecting medium held between the in-head rollers from lifting up, and to prevent a landing position of the liquid from being shifted. In addition, as the in-head roller is accommodated in the first accommodation portion, it is possible to make the interval between the liquid ejecting surface and the landing surface narrow, and to perform fast printing by preventing the landing surface from being shifted.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, the invention will be described in detail based on embodiments.

Embodiment 1

Figure 1:
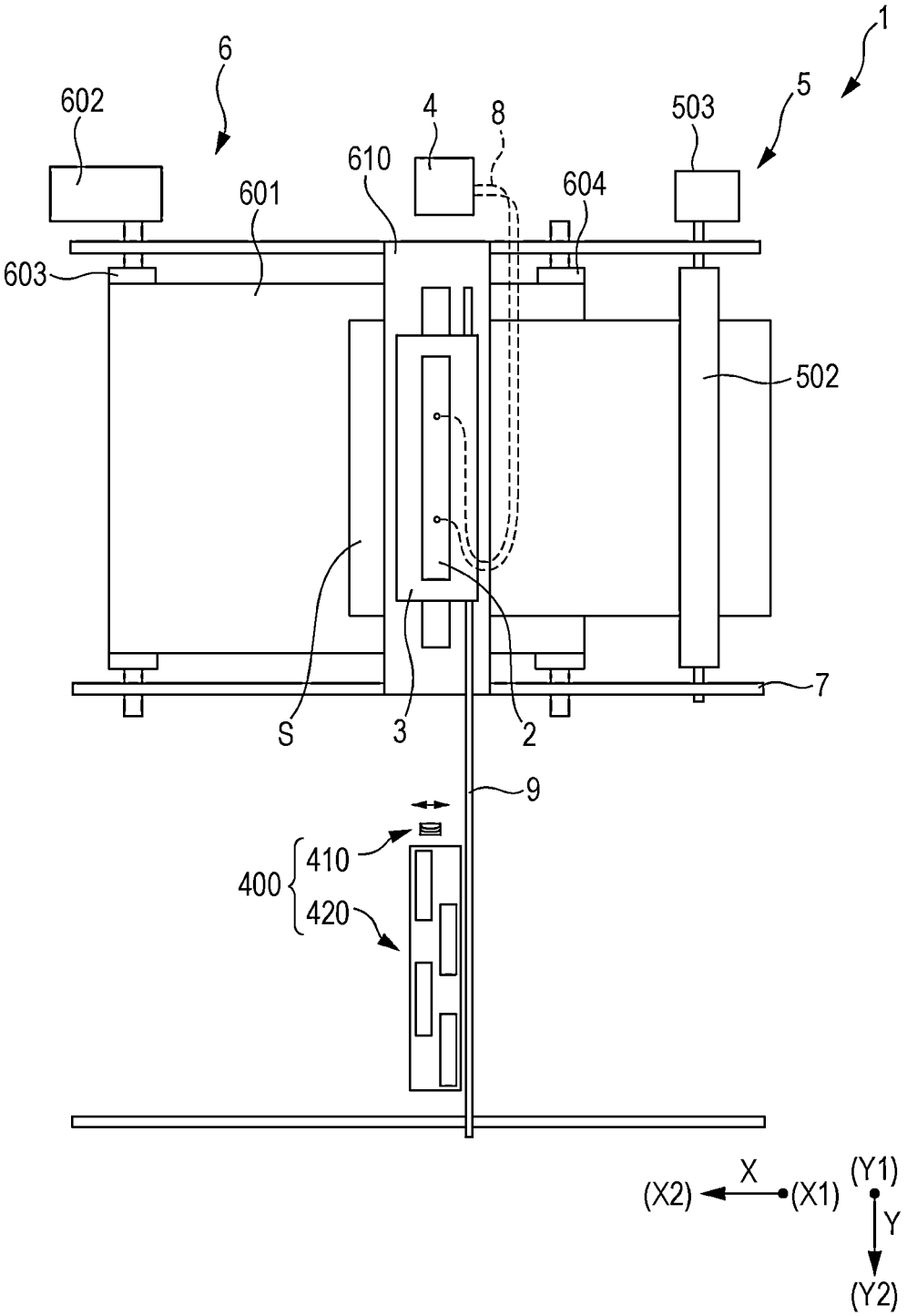
FIG. 1 is a plan view of a recording apparatus according to Embodiment 1.
Figure 2A:
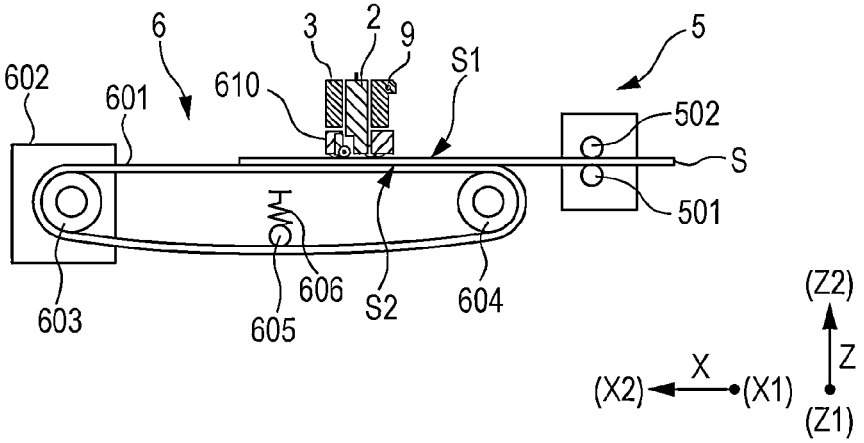
FIGS. 2A and 2B are side views of the recording apparatus according to Embodiment 1.
Figure 2B:
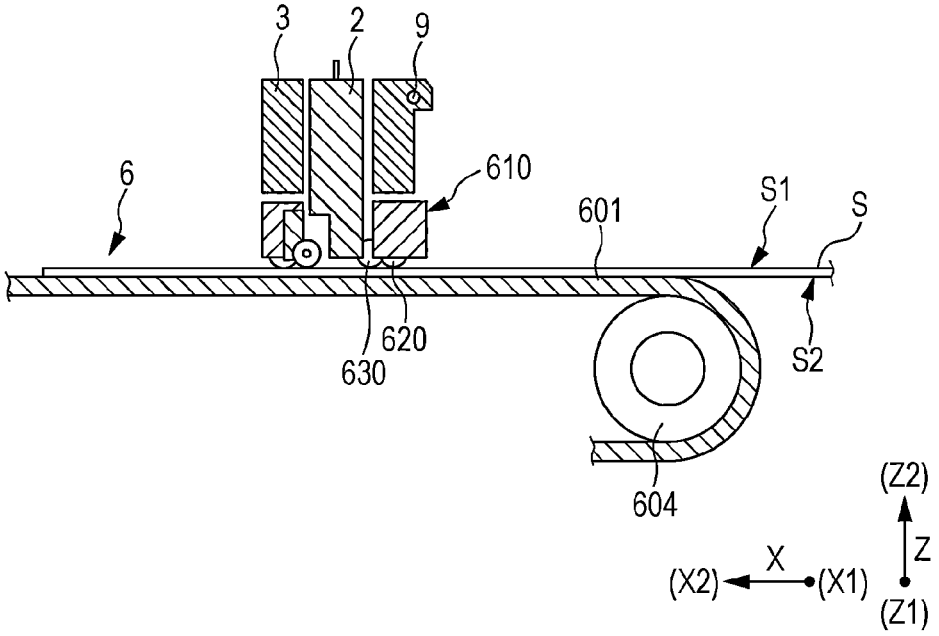

FIG. 1 is a schematic plan view illustrating an ink jet type recording apparatus which is an example of a liquid ejecting apparatus according to Embodiment 1 of the invention. FIGS. 2A and 2B are a side view of the ink jet type recording apparatus and an enlarged view thereof.

As illustrated in FIG. 1, an ink jet type recording apparatus 1 which is an example of the liquid ejecting apparatus of the embodiment is a so-called line type ink jet type recording apparatus 1 which performs printing only by transporting a recording sheet S which is an ejecting medium.

Here, in the embodiment, a transporting direction of the recording sheet S is referred to as a first direction X, and in an inner surface direction of a landing surface of the recording sheet S, on which ink lands, a direction which is orthogonal to the first direction X is referred to as a reference direction or a second direction Y. In addition, a direction which is orthogonal to both the first direction X and the second direction Y, that is, a direction which is orthogonal to the landing surface S1 of the recording sheet S, is referred to as a third direction Z. In the embodiment, each direction (X, Y, Z) illustrates directions which are orthogonal to each other as examples, but the invention is not necessarily limited thereto.

The ink jet type recording apparatus 1 includes an ink jet type recording head unit 2 (hereinafter, simply referred to as a head unit 2), a carriage 3 which has the head unit 2 mounted thereon, a liquid storing unit 4, such as an ink tank which stores the ink, a first transporting unit 5, a second transporting unit 6, an apparatus main body 7, and a maintenance unit 400.

The head unit 2 extends along the second direction Y. In the embodiment, although this will be described in detail later, in the head unit 2, a plurality of head rows 202 in the first direction X, two head rows 202 in the embodiment, in which a plurality of ink jet type recording heads 200 (refer to FIG. 7) is aligned in parallel along the second direction Y, are provided. The number of the head rows 202 of the ink jet type recording heads 200 is not particularly limited, and may be three. The ink jet type recording heads 200 are disposed so that a liquid ejecting surface 20*a* which ejects the ink is a Z1 side.

The liquid storing unit 4 is a unit which supplies the ink to the head unit 2, and is fixed to the apparatus main body 7 in the embodiment. The ink from the liquid storing unit 4 which is fixed to the apparatus main body 7 is supplied to the head unit 2 via a supply tube 8, such as a tube. In addition, the head unit 2 may be provided with the liquid storing unit 4, for example, the head unit 2 may have the liquid storing unit 4 mounted above the head unit 2 in the third direction Z, that is, on a side opposite to the recording sheet S.

The first transporting unit 5 is provided on one side of the head unit 2 in the first direction X, in the embodiment, on an X1 side. In addition, in the embodiment, in the first direction X, one side of the head unit 2 is referred to as the X1 side, and the other side is referred to as an X2 side.

The first transporting unit 5 includes a first transporting roller 501, and a first driven roller 502 which is driven by the first transporting roller 501. The first transporting roller 501 is provided on a rear surface S2 side on a side opposite to the landing surface S1 of the recording sheet S, and is driven by a driving force of a first driving motor 503. In addition, the first driven roller 502 is provided on the landing surface S1 side of the recording sheet S, and pinches the recording sheet S between the first driven roller 502 and the first transporting roller 501. In this manner, the first driven roller 502 presses down the recording sheet S toward the first transporting roller 501 side by a bias member, such as a spring which is not illustrated.

The second transporting unit 6 includes a transporting belt 601, a second driving motor 602, a second transporting roller 603, a second driven roller 604, a tension roller 605, and a roller unit 610.

The second transporting roller 603 of the second transporting unit 6 is driven by a driving force of the second driving motor 602. The transporting belt is made of an endless belt, and is wound around the outer circumference of the second transporting roller 603 and the second driven roller 604. The transporting belt 601 is provided on the rear surface S2 side of the recording sheet S. The tension roller 605 is provided between the second transporting roller 603 and the second driven roller 604, abuts against an inner circumferential surface of the transporting belt 601, and gives tension to the transporting belt 601 by a biasing force of a bias member 606, such as a spring. Accordingly, the transporting belt 601 is disposed between the second transporting roller 603 and the second driven roller 604 so that a surface which faces the head unit 2 is flat.

The roller unit 610 of the second transporting unit 6 is provided on the landing surface S1 side of the recording sheet S, and has a plurality of in-head rollers and out-head rollers on the landing surface S1 side of the recording sheet S. The roller unit 610 pinches the recording sheet S between the out-head roller and the in-head roller, and the transporting belt 601. In addition, the roller unit 610 will be described in detail later.

In the ink jet type recording apparatus 1, while the recording sheet S is transported toward the X2 side from the X1 in the first direction X with respect to the head unit 2 by the first transporting unit 5 and the second transporting unit 6, the ink is ejected from each of the ink jet type recording heads of the head unit 2, the ejected ink lands on the landing surface S1 of the recording sheet S, and so-called printing is performed.

In addition, the carriage 3 of the ink jet type recording apparatus 1 has a plurality of head units 2 mounted thereon, and is provided to be able to move in an axial direction to a carriage axis 9. The carriage axis 9 is disposed so that the axial direction matches the second direction Y, and the driving force of the driving motor which is not illustrated is transmitted to the carriage 3 via the spur or the belt. According to this, the carriage 3 moves in the axial direction of the carriage axis 9. In addition, the carriage 3 and the carriage axis 9 are provided to be able to move in a direction which is orthogonal to the landing surface S1 with respect to the apparatus main body 7 by an ascending and descending unit which is not illustrated, that is, in the third direction Z. In the embodiment, the movement of the head unit 2 in the direction which is orthogonal to the landing surface S1 of the recording sheet S when printing is performed is referred to as ascending and descending. In other words, in the third direction Z, the movement of the head unit 2 in a direction apart from the recording sheet S when printing is performed is referred to as ascending, and the movement of the head unit 2 in an approaching direction to the recording sheet S when printing is performed is referred to as descending. In other words, in the third direction Z, the movement from the Z1 side which is the recording sheet S side to the Z2 side which is apart from the recording sheet S is referred to as ascending, and the movement from the Z2 side which is apart from the recording sheet S to the Z1 side which is the recording sheet S side is referred to as descending.

The carriage 3 ascends from a landing position on which the head unit 2 ejects the ink facing the transporting belt 601 and makes the ink land on the recording sheet S, to the Z2 side in the third direction Z by the ascending and descending unit which is not illustrated. After this, the carriage 3 moves in the second direction Y which is the axial direction of the carriage axis 9, and thus, the carriage 3 moves to a maintenance position which does not face the recording sheet S or the transporting belt 601. In the maintenance position, the maintenance unit 400 which performs maintenance with respect to the head unit 2 is provided. In addition, in the embodiment, in the second direction Y, a side, on which the second transporting unit 6, such as the transporting belt 601 inside the apparatus main body 7, is provided, is referred to as a Y1 side, and the maintenance position side on which the maintenance unit 400 is provided is referred to as a Y2 side.

In the embodiment, the maintenance unit 400 of the ink jet type recording apparatus 1 includes a wiping unit 410 which has a blade that wipes the liquid ejecting surface 20*a*, and a capping unit 420 which has a cap that covers the liquid ejecting surface 20*a*. In addition, the maintenance unit 400 will be described in detail later.

Figure 3:
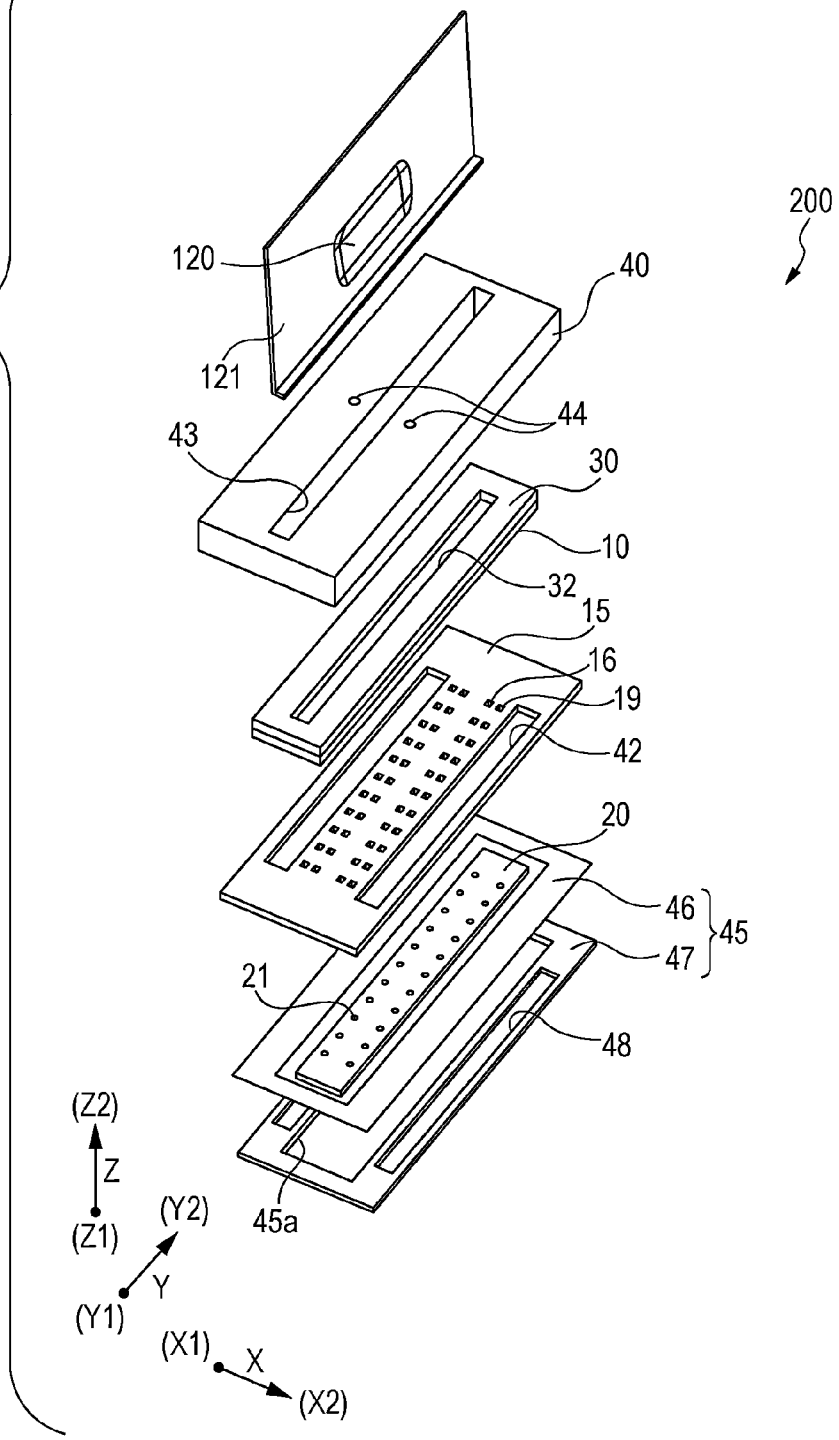
FIG. 3 is an exploded perspective view of a recording head according to Embodiment 1.
Figure 4:
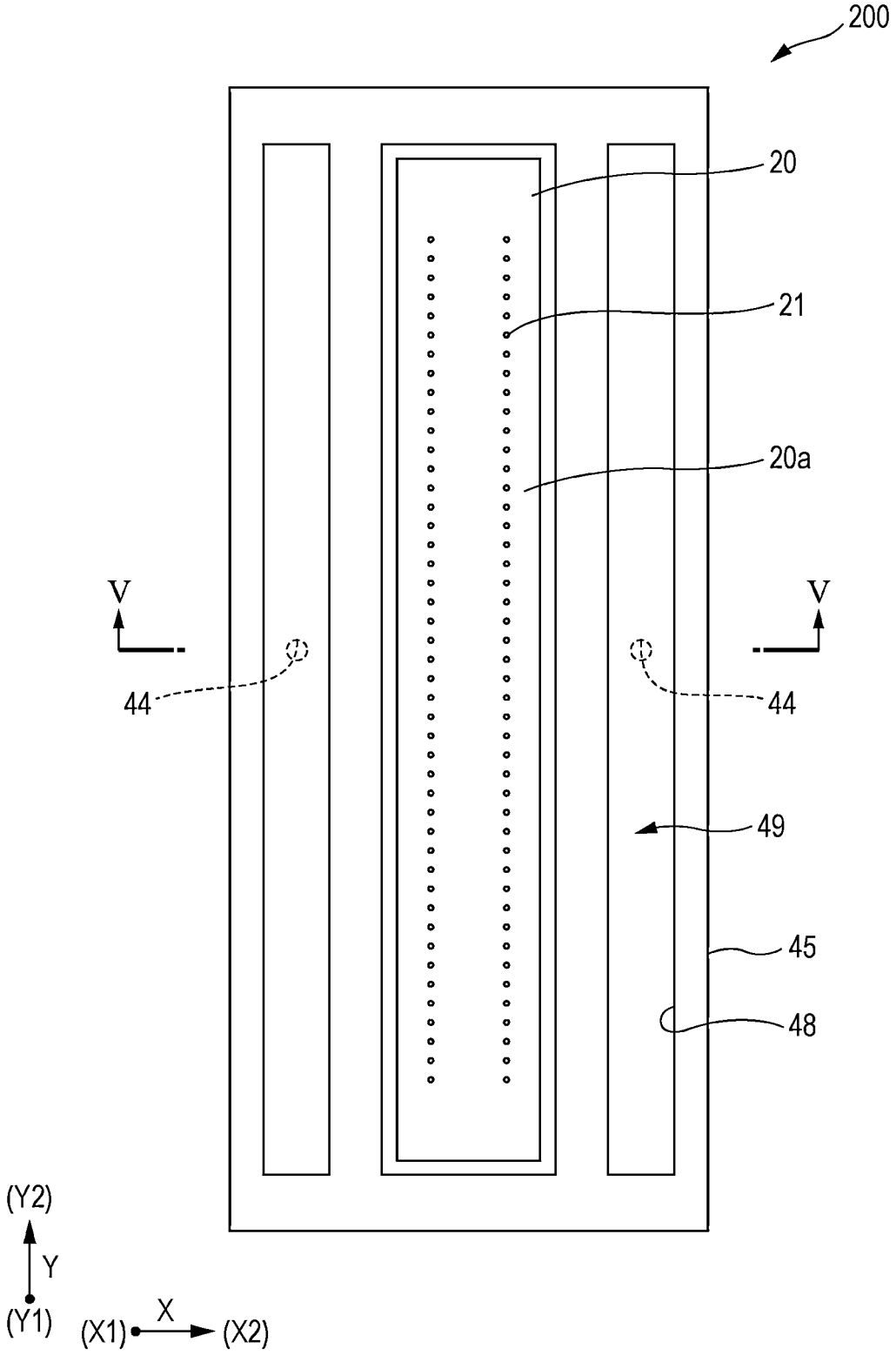
FIG. 4 is a plan view of the recording head according to Embodiment 1.
Figure 5:
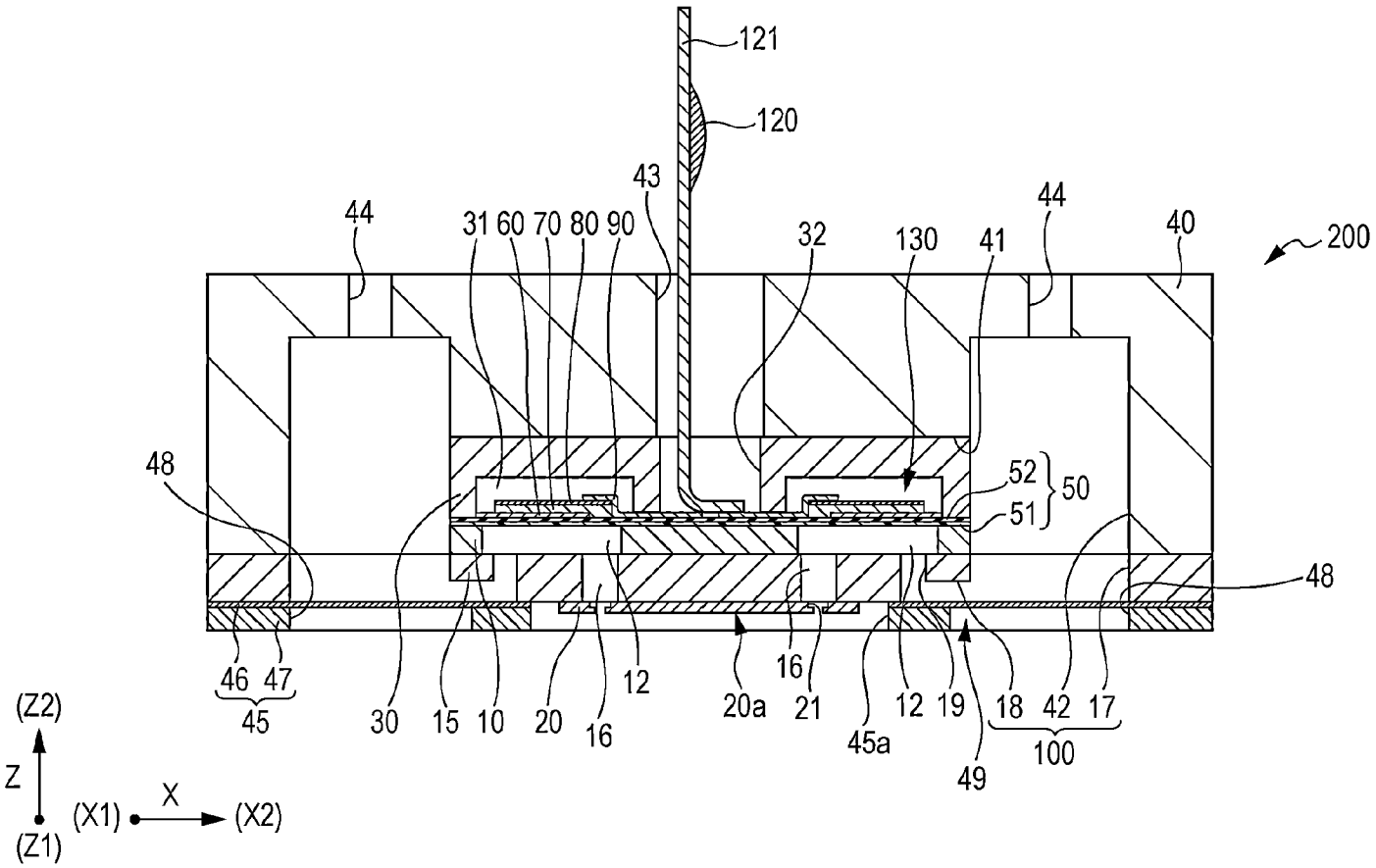
FIG. 5 is a cross-sectional view of the recording head according to Embodiment 1.

Here, first, the ink jet type recording head 200 which is held by the head unit 2 mounted on the ink jet type recording apparatus 1 will be described. In addition, FIG. 3 is an exploded perspective view of the ink jet type recording head of the embodiment. FIG. 4 is a plan view of the ink jet type recording head. FIG. 5 is a cross-sectional view along V-V in FIG. 4. In addition, the ink jet type recording head of the embodiment will be described based on each direction (X, Y, Z) when the ink jet type recording head is mounted on the ink jet type recording apparatus 1.

As illustrated in the drawing, the ink jet type recording head 200 (hereinafter, simply referred to as a recording head 200) of the embodiment is configured of a plurality of members, such as a flow path forming substrate 10, a communication plate 15, a nozzle plate 20, a protection substrate 30, a compliance substrate 45, and a case member 40.

In the flow path forming substrate 10, a pressure generation chambers 12 which is partitioned by a plurality of diaphragms are aligned in parallel. In the embodiment, the recording head 200 is held by the head unit 2 so that a direction of parallel alignment of the pressure generation chambers 12 is the second direction Y, and is mounted in the ink jet type recording apparatus 1. Hereinafter, the direction of parallel alignment of the pressure generation chambers 12 is referred to as the second direction Y. In addition, in the flow path forming substrate 10, a plurality of rows in which the pressure generation chambers 12 are aligned in parallel in the second direction Y, two rows in the embodiment are aligned in parallel in the first direction X which is orthogonal to the second direction Y.

On the Z1 side of the third direction Z of the flow path forming substrate 10, the communication plate 15 and the nozzle plate 20 are sequentially layered. In other words, the communication plate 15 which is provided on a surface on the Z1 side of the third direction Z of the flow path forming substrate 10, and the nozzle plate 20 which has nozzle openings 21 provided on a surface opposite to the flow path forming substrate 10 of the communication plate 15, that is, on the surface on the Z1 side of the communication plate 15, are provided.

In the communication plate 15, a nozzle communication path 16 which communicates with the pressure generation chambers 12 and the nozzle openings 21 is provided. The communication plate 15 has an area which is larger than that of the flow path forming substrate 10, and the nozzle plate 20 has an area which is smaller than that of the flow path forming substrate 10. In this manner, as the communication plate 15 is provided, since the nozzle plate 20 may only cover the opening of the nozzle communication path 16 which makes the pressure generation chambers 12 and the nozzle openings 21 communicate with each other, it is possible to make the area of the 20 relatively small, and to reduce a cost. In addition, in the embodiment, a surface, on which the nozzle openings 21 of the nozzle plate 20 are opened and ink droplets are discharged, is referred to as the liquid ejecting surface 20*a*.

In addition, in the communication plate 15, a first manifold portion 17 and a second manifold portion 18 which constitute a part of a manifold 100, are provided. The first manifold portion 17 is provided to penetrate the communication plate 15 in a thickness direction (layering direction of the communication plate 15 and the flow path forming substrate 10). In addition, the second manifold portion 18 is provided to be opened on the nozzle plate 20 side of the communication plate 15 without penetrating the communication plate 15 in the thickness direction.

Furthermore, in the communication plate 15, a supply communication path 19 which communicates with one end portion of the pressure generation chamber 12 in the first direction X is provided independently in each pressure generation chamber 12. The supply communication path 19 communicates with the second manifold portion 18 and the pressure generation chamber 12.

In the nozzle plate 20, the nozzle openings 21 which penetrate each pressure generation chamber 12 and nozzle communication path 16 are formed. In other words, the nozzle openings 21 constitutes the nozzle rows in which openings which eject the same type of liquid (ink) are aligned in parallel in the second direction Y, and two nozzle rows which are configured of the nozzle openings 21 aligned in parallel in the second direction Y are formed in the first direction X.

Meanwhile, on the Z2 side which is a side opposite to the communication plate 15 of the flow path forming substrate 10, a diaphragm 50 is formed. In the embodiment, as the diaphragm 50, an elastic film 51 which is made of silicon oxide provided on the flow path forming substrate 10 side, and an insulator film 52 which is made of zirconium oxide provided on the elastic film 51, are provided. In addition, on the insulator film 52 of the diaphragm 50, a piezoelectric actuator 130, which is formed as a first electrode 60, a piezoelectric layer 70, and a second electrode 80 are layered, is provided. The piezoelectric actuator 130 functions as a pressure generating unit which causes a change in pressure to the ink in the pressure generation chamber 12 which is a flow path of the embodiment.

In addition, the protection substrate 30, which has substantially the same size as that of the flow path forming substrate 10, is bonded to a surface on the piezoelectric actuator 130 side which is the pressure generating unit of the flow path forming substrate 10. The protection substrate 30 includes a holding portion 31 which is a space for protecting the piezoelectric actuator 130. The holding portion 31 is independently provided in each row which is configured of the piezoelectric actuators 130 aligned in parallel in the second direction Y, and between the two holding portions 31 (in the first direction X), a through hole 32 which penetrates in the thickness direction is provided. A lead-out wiring which is connected to each of the electrodes 60 and 80 of the piezoelectric actuator 130 is pulled out to be exposed to the inside of the through hole 32, and is electrically connected to a wiring substrate 121 inside the through hole 32.

In addition, on the side opposite to the flow path forming substrate 10 of the protection substrate 30, a case member 40 is provided. In a plan view, the case member 40 has substantially the same shape as that of the communication plate 15, and is fixed to the protection substrate 30 and to a surface on the flow path forming substrate 10 side of the communication plate 15 at the same time. In addition, in the case member 40, a third manifold portion 42 which communicates with the second manifold portion 18 is formed, and the manifold 100 of the embodiment is configured of the first manifold portion 17, the second manifold portion 18, and the third manifold portion 42. The manifolds 100 are respectively and independently provided on both outer sides of the two rows of the pressure generation chambers 12. In other words, the manifolds 100 are formed in each row where the pressure generation chambers 12 are aligned in parallel in the second direction Y. In the embodiment, different types of ink are supplied to the two manifolds 100, and the different types of ink are ejected from the two nozzle rows.

Furthermore, in the case member 40, an outlet 44 which penetrates the manifold 100 is provided. In the embodiment, the outlets 44 are provided in each manifold 100. In addition, in the case member 40, a connection port 43, which communicates with the through hole 32 of the protection substrate 30 and through which the wiring substrate 121 is inserted, is provided. The connection port 43 is provided between the two outlets 44 in the first direction X.

Figure 6:
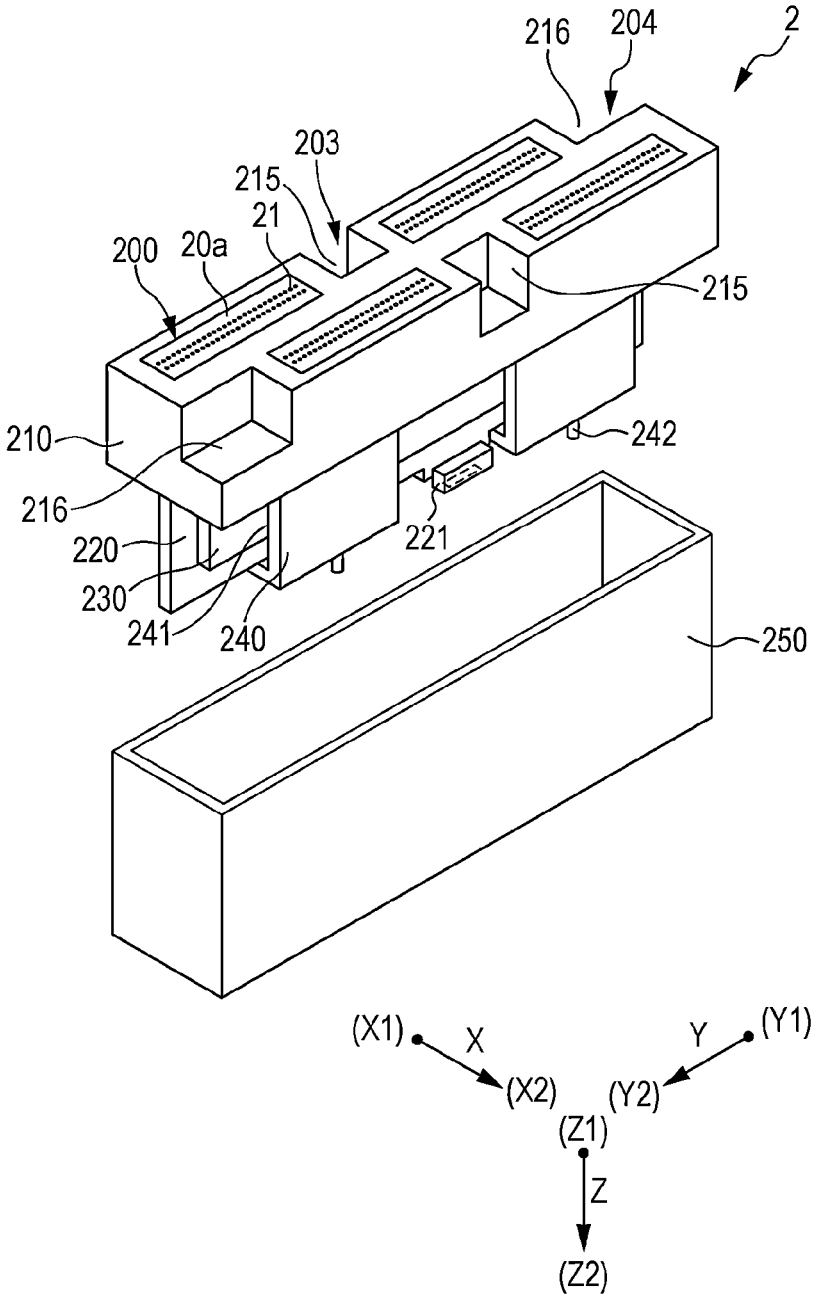
FIG. 6 is an exploded perspective view of a head unit according to Embodiment 1.
Figure 7:
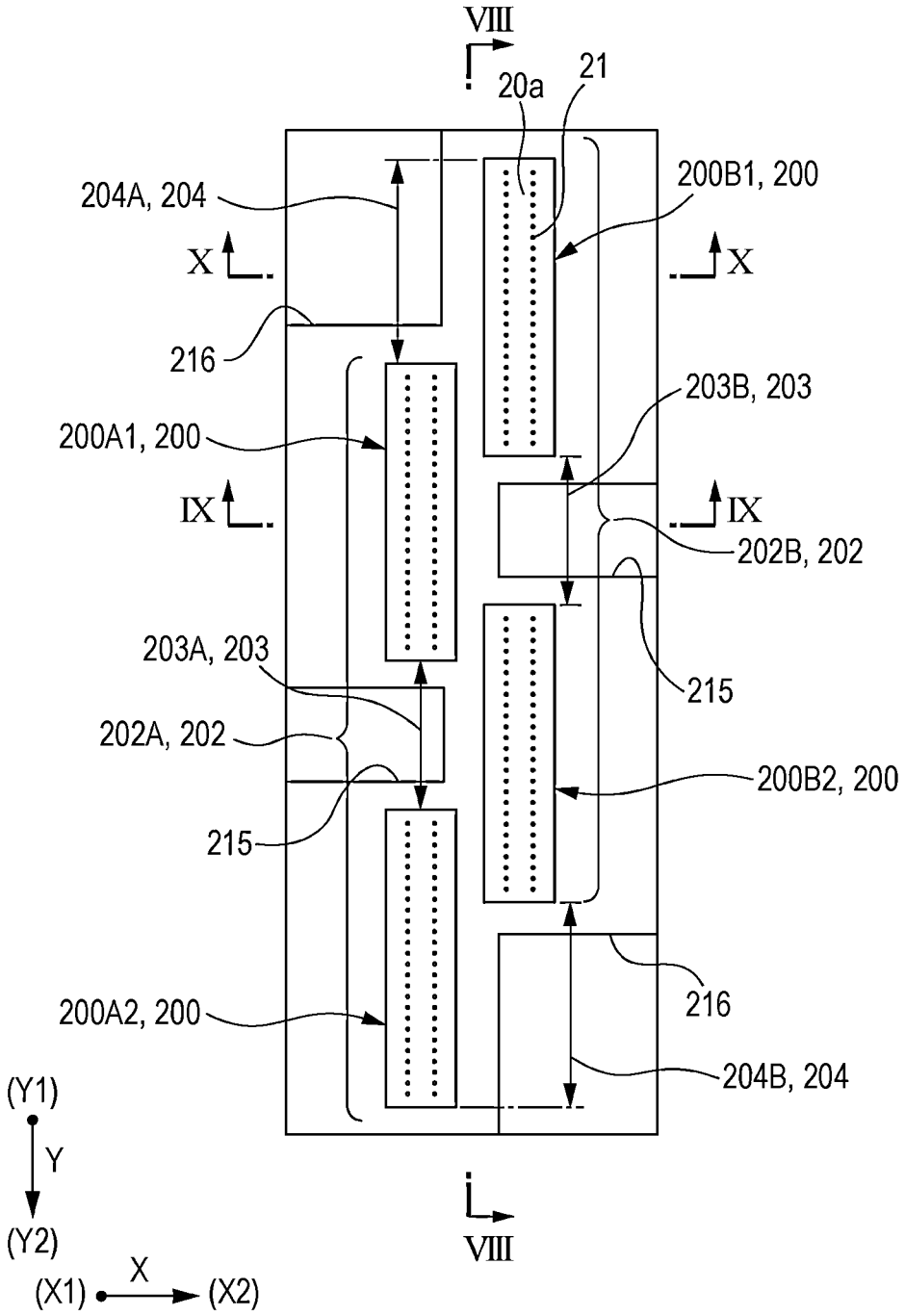
FIG. 7 is a plan view of the head unit according to Embodiment 1.
Figure 8:
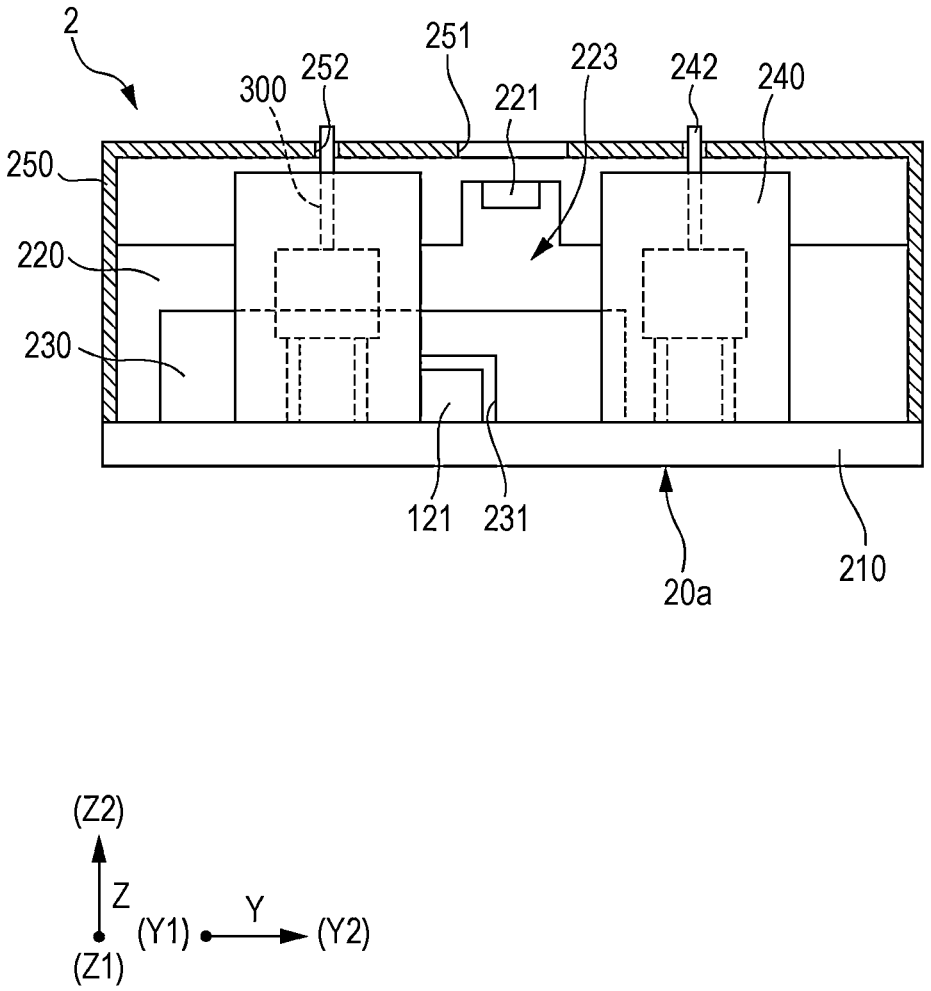
FIG. 8 is a view which cuts out a part of the head unit according to Embodiment 1.
Figure 9:
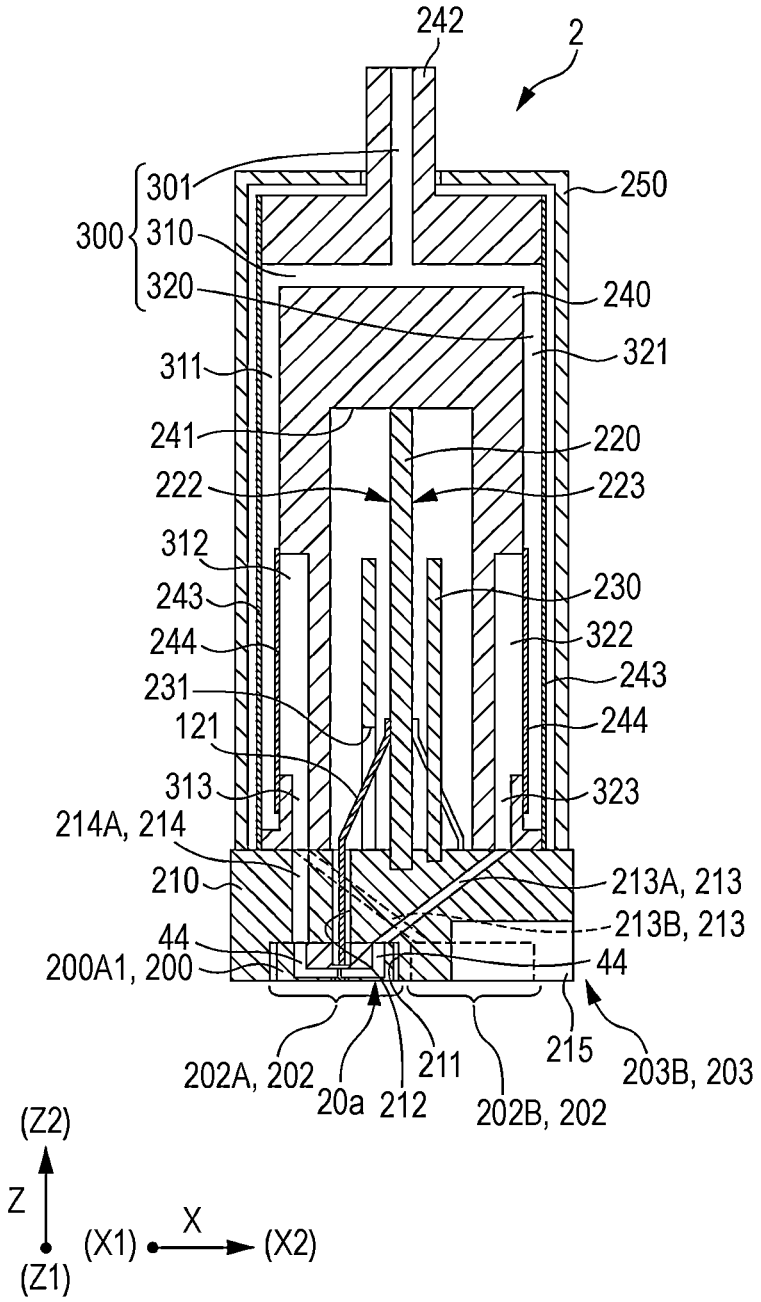
FIG. 9 is a cross-sectional view of the head unit according to Embodiment 1.
Figure 10:
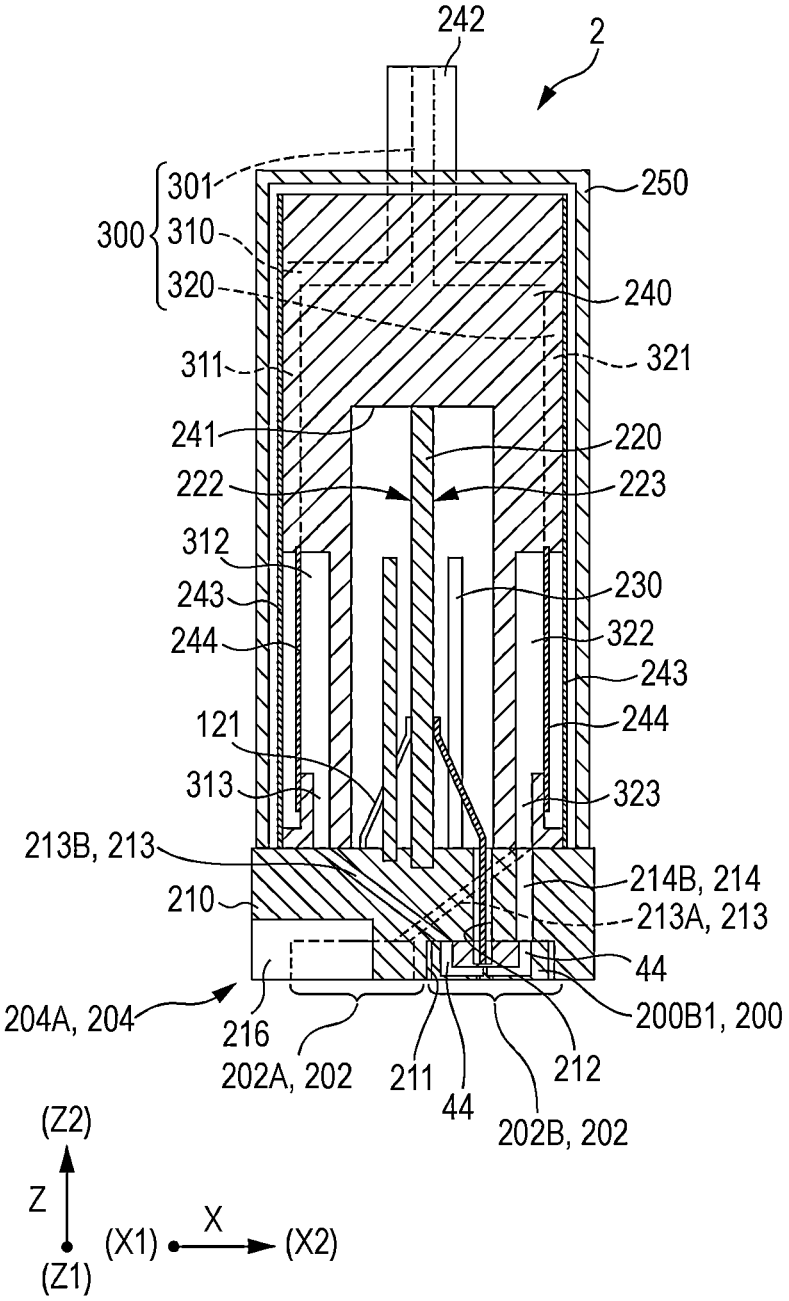
FIG. 10 is a cross-sectional view of the head unit according to Embodiment 1.
Figure 11:
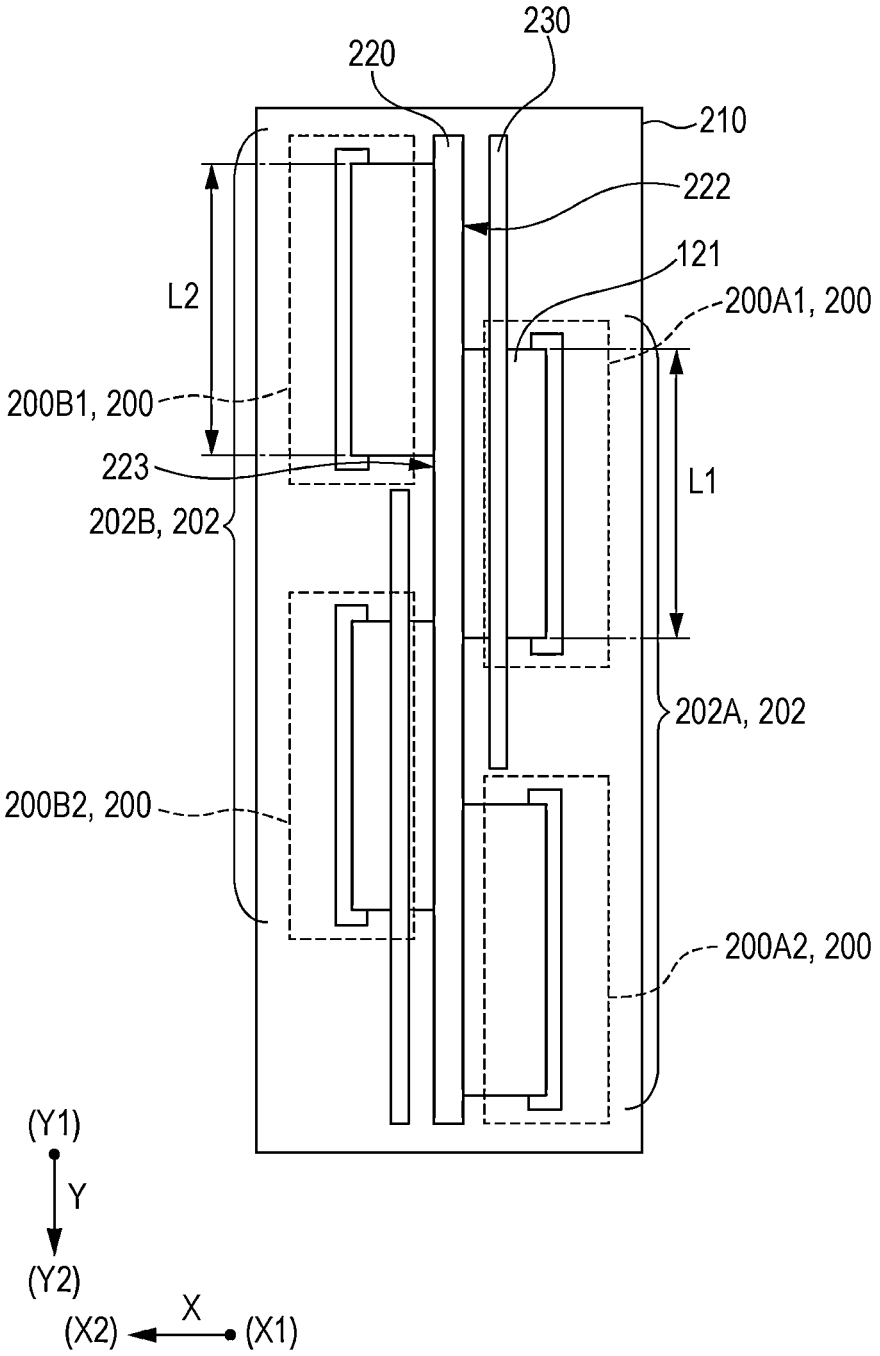
FIG. 11 is a plan view illustrating a connected state of a relay substrate and a wiring substrate according to Embodiment 1.

The recording head 200 is held by the head unit 2. Here, the head unit 2 will be described with reference to FIGS. 6 to 11. In addition, FIG. 6 is an exploded perspective view of a part of the head unit according to Embodiment 1. FIG. 7 is a plan view of the head unit when viewed from the liquid ejecting surface side. FIG. 8 is a view which cuts out a part of the head unit along line VIII-VIII in FIG. 7. FIG. 9 is a cross-sectional view cut along line IX-IX in FIG. 7. FIG. 10 is a cross-sectional view cut along line X-X in FIG. 7. In addition, FIG. 11 is a plan view illustrating a connected state of the relay substrate and the wiring substrate. In addition, the head unit according to the embodiment will be described based on each direction (X, Y, Z) when the head unit is mounted on the ink jet type recording apparatus 1.

As illustrated in the drawings, the head unit 2 includes a plurality of recording heads 200, a holder 210 which holds the plurality of recording heads 200 on the Z1 side which is one surface side in the third direction Z, a relay substrate 220 which is fixed to a surface on the Z2 side of the third direction Z of the holder 210, a correction plate 230 which is fixed to the surface on the Z2 side of the holder 210, a flow path member 240 which is fixed to the surface on the Z2 side of the holder 210, and a cover 250 which is fixed to the surface of the Z2 side of the holder 210. The holder 210 and the cover 250 accommodate the recording heads 200, the relay substrate 220, the correction plate 230, and the flow path member 240, on the inside thereof.

In the embodiment, in one head unit 2, four recording heads 200 are aligned in parallel along the second direction Y. Specifically, the recording heads 200 are held so that the direction of parallel alignment of the pressure generation chambers 12 is the second direction Y of the head unit 2. Two head rows 202, which are configured of two recording heads 200 aligned in parallel making a void 203 in the second direction Y which is the reference direction, are aligned in the first direction X. In the embodiment, the head row 202 provided on the X1 side is referred to as a first head row 202A, and the head row 202 provided on the X2 side is referred to as a second head row 202B. In addition, the recording head 200 on the Y1 side of the first head row 202A is referred to as a recording head 200A1, and the recording head 200 on the Y2 side is referred to as a recording head 200A2. In addition, the recording head 200 on the Y1 side of the second head row 202B is referred to as a recording head 200B 1, and the recording head 200 on the Y2 side is referred to as a recording head 200B2.

The first head row 202A and the second head row 202B are disposed to be shifted from each other in the second direction Y. A shift amount of the first head row 202A and the second head row 202B in the second direction Y is half of a pitch of the recording head 200 which constitutes the head row 202. In the embodiment, the first head row 202A is disposed to be shifted to the Y2 side with respect to the second head row 202B. In other words, a void 203A of the recording heads 200 which are adjacent to each other in the second direction Y in the first head row 202A is provided to face the recording heads 200, in the embodiment, the recording head 200B2, which constitute the second head row 202B, in the first direction X. In addition, a void 203B of the recording heads 200 which are adjacent to each other in the second direction Y in the second head row 202B is provided to face the recording heads 200, in the embodiment, the recording head 200A1, which constitutes the first head row 202A, in the first direction X. As the first head row 202A and the second head row 202B are disposed in this manner, by the four recording heads 200, it is possible to align the nozzle openings 21 continuously in parallel along the second direction Y at the same pitch.

As illustrated in FIGS. 9 and 10, the holder 210 holds the plurality of recording heads 200 on the surface which faces the recording sheet S, that is, the surface on the Z1 side of the third direction Z. In particular, on the surface on the Z1 side of the holder 210, a head holding portion 211 which has a recessed shape that is opened on the Z1 side is provided, and the recording heads 200 are held inside the head holding portion 211.

The holder 210 extends with a size that includes the two head rows 202, in the second direction Y.

In addition, in the holder 210, the relay substrate 220, the correction plate 230, the flow path member 240, and the cover 250, are fixed to the surface on the Z2 side of the third direction Z.

In the holder 210, a wiring insertion hole 212 which penetrates the head holding portion 211 and the surface on the Z2 side in the third direction Z is provided. The wiring substrate 121 of the recording head 200 which is held inside the head holding portion 211 is pulled out to the Z2 side of the holder 210 via the wiring insertion hole 212, and an end portion which is pulled out in the wiring substrate 121 is connected to the relay substrate 220.

The relay substrate 220 is made of a plate-shaped substrate which is fixed to the surface on the Z2 side of the holder 210 in an erected state. In other words, the relay substrate 220 is disposed on the surface on the Z2 side of the holder 210 so that a direction which includes the second direction Y and the third direction Z is a surface direction, and an end portion on the Z1 side of the third direction Z is fixed to the surface on the Z2 side of the holder 210. A fixing position of the relay substrate 220 is substantially the center of the first direction X of the holder 210, and the relay substrate 220 is provided at a corresponding position between the two head rows 202. In other words, each head row 202 is respectively provided on both surfaces of the relay substrate 220.

On both surfaces of the relay substrate 220, an electronic component, such as a capacitor, a transistor, or an integrated circuit, is mounted. In addition, the wiring substrate 121 which is pulled out from each of the recording heads 200 and has flexibility is respectively and electrically connected to the relay substrate 220. In the embodiment, the wiring substrate 121 of the recording head 200 which constitutes the first head row 202A provided on the X1 side of the first direction X of the relay substrate 220, is connected to a first surface 222 on the X1 side of the relay substrate 220. Similarly, the wiring substrate 121 of the recording head 200 which constitutes the second head row 202B provided on the X2 side of the first direction X of the relay substrate 220 is connected to the second surface 223 on the X2 side of the relay substrate 220. In other words, the wiring substrates 121 of each recording head 200 do not cross the relay substrate 220 in the first direction X, and are respectively connected to both surfaces of the relay substrate 220.

In addition, in the embodiment, as illustrated in FIG. 11, a region L1 to which the wiring substrate 121 which is pulled out from the recording head 200 of the first head row 202A is connected, and a region L2 to which the wiring substrate 121 which is pulled out from the recording head 200 of the second head row 202B is connected, are disposed so that at least some parts thereof are overlapped with each other in the first direction X. In this manner, in order to connect the relay substrate 220 and the wiring substrate 121 to each other on both surfaces 222 and 223 of the relay substrate 220, even when a part of the recording head 200 is overlapped in the first direction X, and some parts of each of the regions L1 and L2 which are connected to the relay substrate 220 of the wiring substrate 121 are overlapped with each other in the first direction X, it is possible to easily connect the wiring substrate 121 and the relay substrate 220 of the recording head 200 to each other. In contrast, for example, when the entire wiring substrate 121 of the recording head 200 is connected only to one surface of the relay substrate 220, the wiring substrates 121 interfere with each other. For this reason, in order to prevent the connected parts of the wiring substrate 121 from interfering with each other, it is required that a part at which the wiring substrate 121 is connected to the relay substrate 220 is changed to a different position in the third direction Z, and then, the relay substrate 220 becomes large in size in the third direction Z. In the embodiment, since a connection wiring 120 is connected to both surfaces of the relay substrate 220, it is possible to reduce the size of the relay substrate 220 in the third direction Z. In addition, at least some parts of the region L1 to which the wiring substrate 121 which is pulled out from the recording head 200 of the first head row 202A is connected, and the region L2 to which the wiring substrate 121 which is pulled out from the recording head 200 of the second head row 202B is connected, are overlapped with each other in the first direction X because the wiring substrate 121 having a wide width in the second direction Y is used. In other words, when the wiring substrate 121 having a narrow width in the second direction Y is used, the connected parts of the wiring substrate 121 and the relay substrate 220 are not positioned to be overlapped with each other in the first direction X. However, in recent years, in the recording head 200, since the number of the nozzles provided with many nozzle openings has been increased, and the density of the nozzle openings has been increased, a small size of the nozzle openings is achieved in accordance with high density of the nozzle openings, and the number of wirings is increased in accordance with the increased number of the nozzles. Therefore, it is difficult to narrow the width of the wiring substrate 121 in the second direction Y, and in practice, the width of the wiring substrate 121 in the second direction Y is substantially the same as the width of the recording head 200 in the second direction Y. In addition, since it is possible to dispose some parts of the wiring substrates 121 which are connected to the first surface 222 and the second surface 223 of the wiring substrate 121 to be overlapped with each other, it is possible to freely design an overlapped amount of the recording heads 200 which are adjacent to each other in the second direction Y, in the first direction X. Therefore, it is possible to increase the number of the nozzle openings 21 which are at the same position in the first direction X of the recording heads 200 that are adjacent to each other in the second direction Y, and to reduce deterioration of a printing quality in the joint of the recording heads 200 in the second direction Y.

In addition, the regions L1 and L2 to which the wiring substrate 121 of the relay substrate 220 is connected are provided on the side opposite to the liquid ejecting surface 20*a* rather than the surface to which a flow path 300 of the flow path member 240 of the holder 210 is connected, in the third direction Z. Accordingly, when the wiring substrate 121 and the relay substrate 220 are connected to each other by a heating tool or the like, the part to which the flow path 300 of the holder 210 is connected does not interfere, and it is possible to easily and reliably connect the wiring substrate 121 and the relay substrate 220 to each other.

In addition, in the relay substrate 220, as illustrated in FIG. 8, in the third direction Z, a connector 221 is provided on a side opposite to the holder 210, that is, in an end portion on the Z2 side. In the embodiment, the connectors 221 of the relay substrate 220 extend the relay substrate 220 to the Z2 side between the two flow path members 240, and are respectively provided on a surface on the X1 side and a surface on the X2 side of the extended end portion. A control portion is connected to the connector 221 via an outside wiring which is not illustrated. Accordingly, a signal or the like from the control portion is supplied to the relay substrate 220 via the connector 221, and are supplied to the recording head 200 via the wiring substrate 121 from the relay substrate 220. In addition, in the cover 250, a connector exposure hole 251 for exposing the connector 221 to the outside in a region which corresponds to the connector 221 is provided, and the outside wiring is connected to the exposed connector 221 by the connector exposure hole 251.

As illustrated in FIGS. 9 to 11, the correction plate 230 is made of a plate-shaped member which is fixed to a surface on the Z2 side of the holder 210, and is disposed so that a surface direction of the relay substrate 220, that is, the direction which includes the third direction Z and the second direction Y, is the surface direction. In the embodiment, two correction plates 230 nip the relay substrate 220 and are fixed to the surface on the Z2 side of the holder 210.

The correction plate 230 has a smaller area than that of the relay substrate 220, and the correction plates 230 are disposed with a certain interval between the correction plate 230 and the relay substrate 220 on both surface sides of the relay substrate 220. In addition, the correction plate 230 includes an opening portion 231 which can be inserted through the wiring substrate 121 at a position which faces the connected part where the relay substrate 220 and the wiring substrate 121 are connected to each other, in the first direction X. The opening portion 231 is formed to be cut out in a recessed shape to the middle of the Z2 side from the end portion on the Z1 side which is fixed to the holder 210 of the correction plate 230. In addition, in the embodiment, the correction plate 230 has a longer length than that of the holder 210 in the second direction Y, and the two correction plates 230 are respectively disposed on the Y1 side and the Y2 side of the second direction Y of the holder 210. Specifically, the correction plate 230 which is provided on the X1 side more than the relay substrate 220 is provided on the end portion side on the Y1 side with respect to the holder 210, and is formed with a length which does not reach the wiring substrate 121 of the recording head 200A2 on the Y2 side. In other words, in the correction plate 230 on the X1 side, only one opening portion 231 which is inserted through the wiring substrate 121 of the recording head 200A1 is provided, and the wiring substrate 121 of the recording head 200A2 on the Y2 side is connected to the relay substrate 220 on the Y2 side which is an outer side of the correction plate 230. In addition, the correction plate 230 which is provided on the X2 side is provided on the end portion side on the Y2 side with respect to the holder 210, and is formed with a length which does not reach the wiring substrate 121 of the recording head 200B 1 on the Y1 side. In other words, in the correction plate 230 on the X2 side, only one opening portion 231 which is inserted through the wiring substrate 121 of the recording head 200B2 is provided, and the wiring substrate 121 of the recording head 200A1 on the Y1 side is connected to the relay substrate 220 on the Y1 side which is the outer side of the correction plate 230. Some parts of the correction plates 230 which are provided on the X1 side and the X2 side in this manner are provided to face each other in the first direction X, in the center portion of the second direction Y of the holder 210. In other words, the two correction plates 230 are provided along substantially the entire holder 210 in the second direction Y to be overlapped with each other in the first direction X.

In addition, the correction plate 230 is made of a material having higher rigidity than that of the holder 210, for example, a metal plate, and as the correction plate 230 is bonded to the holder 210, a bend of the holder 210 in the third direction Z is corrected. In other words, even if the bend is generated when the holder 210 is manufactured or heated, as the correction plate 230 is bonded to the holder 210 in a state where the bend of the holder 210 is corrected, it is possible to maintain the state where the bend of the holder 210 is corrected. Accordingly, it is possible to increase flatness of the surface on the Z1 side to which the recording head 200 of the holder 210 is bonded, and to prevent the landing position of the ink on the recording sheet S from being shifted. In addition, the correction plate 230 is not formed with a length along the entire holder 210 in the second direction Y when the correction plate 230 is only one as described above. However, as the two correction plates 230 are disposed to be shifted from each other in the second direction Y, the two correction plates 230 are overlapped with each other and can be formed along substantially the entire holder 210 in the second direction Y, and it is possible to efficiently correct the bend of the holder 210. In other words, it is also considered to form one correction plate 230 with a length along substantially the entire holder 210 in the second direction Y. However, two opening portions 231 which are inserted through the wiring substrate 121 are necessary in the correction plate 230, an extra region for forming the opening portion 231 is necessary, and the size of the holder 210 becomes large in the second direction Y. In the embodiment, as the opening portions 231 are respectively provided one by one in the two correction plates 230, the extra region is not necessary in the correction plate 230, and it is possible to reduce the size of the holder 210 in the second direction Y.

As illustrated in FIGS. 8 to 10, the flow path member 240 supplies the ink introduced from the liquid storing unit 4 to the recording head 200, and is provided with the flow path 300 on the inside thereof.

As illustrated in FIGS. 6 and 8, the flow path members 240 of the embodiment are provided one by one with respect to the two ink jet type recording heads which are close to each other in the first direction X. In other words, two flow path members 240, including the flow path member 240 which is common to the recording head 200A1 on the Y1 side of the first head row 202A and to the recording head 200B1 on the Y1 side of the second head row 202B, and the flow path member 240 which is common to the recording head 200A2 on the Y2 side of the first head row 202A, and to the recording head 200B2 on the Y2 side of the second head row 202B, are provided.

As illustrated in FIGS. 8 to 10, the flow path members 240 are disposed on both surface sides of the relay substrate 220 to cross the relay substrate 220 in the first direction X. In the embodiment, the flow path member 240 is provided to be continuous to cross the relay substrate 220 and the two correction plates 230 in the first direction X. Specifically, the flow path member 240 has substantially the same width as the width of the holder 210 in the first direction X, and a recess portion 241 which is opened on the surface on the Z1 side in the center portion of the first direction X is formed. The recess portion 241 is formed to have a width that can insert the relay substrate 220 and the two correction plates 230, and be deeper than a height from the surface on the Z2 side of the holder 210 in the third direction Z to the end portion (excluding a part at which the connector 221 is provided) on the Z2 side of the relay substrate 220. Accordingly, as the relay substrate 220 and the two correction plates 230 are inserted into the recess portion 241 of the flow path member 240, the relay substrate 220 and the two correction plates 230 can be fixed to the surface on the Z2 side of the holder 210 on both sides of the region where the relay substrate 220 and the two correction plates 230 are fixed to the holder 210.

Inside the flow path member 240, the flow path 300 is provided. The flow path 300 includes an outlet 301 to which the supply tube 8 is connected, a first flow path 310 which is branched into two from the outlet 301 and is provided on the X1 side of the relay substrate 220, and a second flow path 320 which is provided on the X2 side of the relay substrate 220.

The outlet 301 is provided to be opened at a tip end of a connection portion 242 provided to be protruded on the surface on the Z2 side of the third direction Z of the flow path member 240. As the supply tube 8 is connected to the connection portion 242, the supply tube 8 and the outlet 301 communicate with each other. In addition, in the cover 250, a connection portion insertion hole 252, through which the connection portion 242 is inserted, is provided, and the supply tube 8 is connected to the end portion which is inserted through the connection portion insertion hole 252 of the connection portion 242.

The first flow path 310 and the second flow path 320 are provided to respectively communicate with the two outlets 44 which are respectively provided in the recording heads 200. Specifically, the first flow path 310 includes a first communication path 311 which communicates with the outlet 301, a first liquid reserving portion 312 which communicates with the first communication path 311, and two first supply paths 313 which communicate with the first liquid reserving portion 312.

In addition, a part of the first communication path 311 and the first liquid reserving portion 312 have a recessed shape which is provided to be opened on the surface on the X1 side, which is a side surface of the flow path member 240, that is, a surface on a side opposite to the relay substrate 220. A part of the first communication path 311 and an opened part of the first liquid reserving portion 312 are sealed by a film 243.

In addition, a filter 244 for removing foreign substances, such as dust or bubbles, is provided in the first liquid reserving portion 312, and the ink which flows into the first liquid reserving portion 312 from the first communication path 311 passes through the filter 244 and is supplied to the two first supply paths 313 from the first communication path 311.

Here, in the flow path member 240 on the Y1 side of the second direction Y among the two flow path members 240, the first liquid reserving portion 312 extends in the second direction Y to cross two recording heads, including the recording head 200A1 on the Y1 side of the first head row 202A aligned in parallel in the second direction Y, and the recording head 200B1 on the Y1 side of the second head row 202B. The two first supply paths 313 are aligned in parallel in the second direction Y, and the two first supply paths 313 are opened on the surface on the Z1 side of the flow path member 240. The two first supply paths 313 supply the ink to the recording head 200A1 on the Y1 side of the first head row 202A, and to the recording head 200B1 on the Y1 side of the second head row 202B.

In addition, as described above, each recording head 200 includes two outlets 44 which are apart from each other in the first direction X, but one of the first supply path 313 communicates with the outlet 44 on the X1 side of the recording head 200A1 on the Y1 side of the first head row 202A, and the other first supply path 313 communicates with the outlet 44 on the X1 side of the recording head 200B1 on the Y1 side of the second head row 202B. In addition, each of the first supply paths 313 and the outlets 44 are connected to each other via the connecting flow path which is made of a first connecting flow path 213 and a second connecting flow path 214 which are provided in the holder 210.

The second flow path 320 includes a second communication path 321 which communicates with the outlet 301, a second liquid reserving portion 322 which communicates with the second communication path 321, and two second supply paths 323 which communicate with the second liquid reserving portion 322.

In addition, a part of the second communication path 321 and the second liquid reserving portion 322 have a recessed portion which is provided to be opened on the surface on the X2 side, which is the side surface of the flow path member 240, that is, the surface on the side opposite to the relay substrate 220. A part of the second communication path 321 and an opened part of the second liquid reserving portion 322 are sealed by the film 243.

In addition, the filter 244 for removing the foreign substances, such as dust or bubbles, is provided in the second liquid reserving portion 322, and the ink which flows into the second liquid reserving portion 322 from the second communication path 321 passes through the filter 244 and is supplied to the two second supply paths 323 from the second liquid reserving portion 322.

Here, in the same manner, in the flow path member 240 on the Y1 side, the second liquid reserving portion 322 extends in the second direction Y to cross two recording heads, including the recording head 200A1 on the Y1 side of the first head row 202A aligned in parallel in the second direction Y, and the recording head 200B1 on the Y1 side of the second head row 202B. The two second supply paths 323 are aligned in parallel in the second direction Y, and the two second supply paths 323 are opened on the surface on the Z1 side of the flow path member 240. The two second supply paths 323 supply the ink to the recording head 200A1 on the Y1 side of the first head row 202A, and to the recording head 200B1 on the Y1 side of the second head row 202B.

In addition, as described above, each recording head 200 includes two outlets 44 which are apart from each other in the first direction X, but one of the second supply path 323 communicates with the outlet 44 on the X2 side of the recording head 200A1 on the Y1 side of the first head row 202A, and the other second supply path 323 communicates with the outlet 44 on the X2 side of the recording head 200B1 on the Y1 side of the second head row 202B. In addition, each of the second supply paths 323 and the outlets 44 are connected to each other via the first connecting flow path 213 and the second connecting flow path 214 which are provided in the holder 210.

The flow path member 240 on the Y2 side of the second direction Y among the two flow path members 240 is also configured in a similar manner, and includes the first supply path 313 which communicates with the outlet 44 on the X1 side of the recording head 200A2 on the Y2 side of the first head row 202A, the first supply path 313 which communicates with the outlet 44 on the X1 side of the recording head 200B2 on the Y2 side of the second head row 202B, the second supply path 323 which communicates with the outlet 44 on the X2 side of the recording head 200A2 on the Y2 side of the first head row 202A, and the second supply path 323 which communicates with the outlet 44 on the X2 side of the recording head 200B2 on the Y2 side of the second head row 202B.

In the holder 210, the first connecting flow path 213 and the second connecting flow path 214 are provided with respect to one recording head 200. In the embodiment, since the four recording heads 200 are fixed to the holder 210, a total of eight first connecting flow paths 213 and second connecting flow paths 214 are provided. Specifically, a second connecting flow path 214A which communicates with the outlet 44 on the X1 side of the recording head 200A1 on the Y1 side of the first head row 202A extends in a straight line shape along the third direction Z, on the X1 side of the relay substrate 220, and communicates with the first supply path 313. In addition, a first connecting flow path 213A, which communicates with the outlet 44 on the X2 side of the recording head 200A1, communicates with the second supply path 323 on the X2 side with respect to the relay substrate 220, as the first connecting flow path 213A extends in a straight line shape along a direction which is inclined with respect to the third direction Z, and is provided to be continuous to cross the relay substrate 220 on the Z1 side of the relay substrate 220 in the first direction X, that is, to cross the relay substrate 220 on the X2 side from the X1 side of the relay substrate 220. In other words, The first connecting flow path 213A is provided to be inclined toward the X1 side of the relay substrate 220 which is provided with the recording head 200A1 from the X2 side which is connected to the second supply paths 323 with respect to the relay substrate 220. Accordingly, it is possible to easily connect the second supply paths 323 which are provided on the X2 side of the relay substrate 220 to the outlet 44 on the X2 side of the recording head 200A1 provided on the X1 side via the first connecting flow path 213A. In other words, in the embodiment, the wiring insertion hole 212, the first connecting flow path 213, and the second connecting flow path 214 are disposed so that tracks thereof do not intersect each other when viewed from the reference direction which is the second direction Y For this reason, it is possible to easily guide the wiring substrate 121 and the connecting flow path. In addition, the first connecting flow path 213A of the embodiment extends in a straight line shape along the direction which is inclined with respect to the third direction Z, but the first connecting flow path 213A is not particularly limited thereto, and for example, may be configured of a vertical flow path provided along the third direction Z and a horizontal flow path provide along the first direction X. In other words, in the first connecting flow path 213A, a part which is connected to the flow path 300 may be provided on the recording heads 200B1 and 200B2 sides of the second head row 202B more than the recording head 200A1, in the first direction X. However, as the second connecting flow path 214A which is inclined is provided as described in the embodiment, it is possible to form one component by molding the holder 210, and to reduce a cost by reducing the number of components compared to a case where the horizontal flow path or the like is provided. In addition, even when the first connecting flow path 213A extends in a straight line shape along the direction which is inclined with respect to the third direction Z, and even when the first connecting flow path 213A is configured of the vertical flow path provided along the third direction Z and the horizontal flow path along the first direction X, the first connecting flow path 213A may be a flow path which is inclined with respect to the direction Z, from the Z2 side to the Z1 side of the holder 210 provided with the first connecting flow path 213A.

Similarly, a second connecting flow path 214B which communicates with the outlet 44 on the X2 side of the recording head 200B1 on the Y1 side of the second head row 202B extends in a straight line shape along the third direction Z and communicates with the second supply path 323, on the X2 side of the relay substrate 220. In addition, a first connecting flow path 213B, which communicates with the outlet 44 on the X1 side of the recording head 200B1, communicates with the first supply path 313 on the X1 side of the relay substrate 220, as the first connecting flow path 213B extends in a straight line shape along a direction which is inclined with respect to the third direction Z, and is provided to be continuous to cross the relay substrate 220 on the Z1 side of the relay substrate 220 in the first direction X, that is, to cross the relay substrate 220 from the X2 side to the X1 side of the relay substrate 220. In other words, the first connecting flow path 213B is provided to be inclined toward the X2 side of the relay substrate 220 which is provided with the recording head 200B1 from the X1 side which is connected to the first supply path 313 with respect to the relay substrate 220. Accordingly, it is possible to easily connect the first supply path 313 which is provided on the X1 side of the relay substrate 220 to the outlet 44 on the X1 side of the recording head 200B1 provided on the X2 side via the first connecting flow path 213B. In addition, the first connecting flow path 213B of the embodiment extends in a straight line shape along the direction which is inclined with respect to the third direction Z, but similarly to the first connecting flow path 213A, for example, may be configured of the vertical flow path provided along the third direction Z and the horizontal flow path provided along the first direction X. In addition, even when the first connecting flow path 213B extends in a straight line shape along the direction which is inclined with respect to the third direction Z, and even when the first connecting flow path 213B is configured of the vertical flow path provided along the third direction Z and the horizontal flow path along the first direction X, the first connecting flow path 213B may also be a flow path which is inclined with respect to the direction Z from the Z2 side to the Z1 side of the holder 210 provided with the first connecting flow path 213B.

In addition, the repeated description of the flow path member 240 which is provided corresponding to the recording head 200A2 on the Y2 side of the first head row 202A, and the recording head 200B2 on the Y2 side of the second head row 202B, will be omitted since the configuration thereof is similar to the above-described configuration of the flow path member 240.

As described above, the width of a part which is connected to the recording head 200 in the first direction X which is the transporting direction, in the first connecting flow path 213 and the second connecting flow path 214 which are connected to one recording head 200, becomes narrower than the width of the part which is connected to the flow path 300 of the flow path member 240. In other words, it is possible to make the interval between the two nozzle rows aligned in parallel in the first direction X narrow, and the landing position of the ink ejected from the two nozzle rows is unlikely to be shifted.

In addition, in the embodiment, the two first connecting flow paths 213 which are connected to the recording head 200A1 and the recording head 200A2 that constitute the first head row 202A are disposed so that the tracks thereof do not intersect each other when viewed from the second direction Y which is the reference direction. Therefore, it is possible to reduce a space which accommodates the two first connecting flow paths 213 in the first direction X and make the size of the apparatus small. The two first connecting flow paths 213 of the second head row 202B also have a similar configuration.

As illustrated in FIGS. 7 and 9, in the holder 210, a first accommodation portion 215, which is cut out in a recessed shape in the void 203 between the recording heads 200 which are aligned in parallel in the second direction Y, is provided in each of head rows 202. In other words, the first accommodation portion 215 is provided in the void 203A of the first head row 202A and the void 203B of the second head row 202B.

The first accommodation portion 215 is provided to be opened on the surface on the Z1 side of the holder 210, and to be opened on one side surface of the first direction X. In other words, the first accommodation portion 215 which is provided in the void 203A of the first head row 202A provided on the X1 side is opened on the side surface on the X1 side of the holder 210. In addition, the first accommodation portion 215 which is provided in the void 203B of the second head row 202B provided on the X2 side is opened on the side surface on the X2 side of the holder 210. In addition, in the embodiment, the head rows 202 are configured of the two recording heads 200, and is provided with one void 203. For this reason, one first accommodation portion 215 is provided in each head row 202. When the head rows 202 are configured of three or more recording heads 200, since two or more void 203 are formed, two or more first accommodation portions 215 may be provided in each head row 202. The first accommodation portion 215 is formed with a depth which does not interfere with the second connecting flow path 214. In other words, as the first connecting flow path 213 is provided to be inclined with respect to the third direction Z, it is possible to form the first accommodation portion 215 on the Z1 side of the first connecting flow path 213. In contrast, if the first connecting flow path 213 is provided to go through the Z1 side of the holder 210, the first accommodation portion 215 cannot be provided. When the first accommodation portion 215 interferes with the first connecting flow path 213, a part at which the first connecting flow path 213 is formed inside may be provided to be protruded at a part of the first accommodation portion 215.

In addition, in the holder 210, as the first head row 202A and the second head row 202B are disposed to be shifted from each other in the second direction Y, an interval 204 is provided in the second direction Y between the end portion of the first head row 202A and the end portion of the second head row 202B. In other words, the intervals 204 are respectively provided on the Y1 side of the first head row 202A and the Y2 side of the second head row 202B. In the embodiment, the interval 204 provided on the Y1 side of the first head row 202A is referred to as an interval 204A, and the interval 204 provided on the Y2 side of the second head row 202B is referred to as an interval 204B.

As illustrated in FIGS. 7 and 10, in each interval 204, a second accommodation portion 216 which is cut out in a recessed shape is provided. The second accommodation portion 216 is provided to be opened on the surface on the Z1 side of the holder 210, and to be opened on one side surface of the first direction X and one side surface of the second direction Y. In other words, the second accommodation portion 216 provided in the interval 204A on the X1 side is provided to be opened on the side surface on the X1 side and the side surface on the Y2 side of the holder 210. In addition, the second accommodation portion 216 provided in the interval 204B on the X2 side is provided to be opened on the side surface on the X2 side and the side surface on the Y1 side of the holder 210. In other words, the second accommodation portion 216 provided in the interval 204A faces the recording head 200B2 of the second head row 202B in the first direction X, and the second accommodation portion 216 provided in the interval 204B faces the recording head 200A1 of the first head row 202A in the first direction X.

Although this will be described in detail later, in the first accommodation portion 215 and the second accommodation portion 216, in the embodiment, at least a part of an in-head roller 630 of the roller unit 610 is accommodated.

In addition, as illustrated in FIGS. 2A and 2B, the head unit 2 is mounted so that the liquid ejecting surface 20*a* side is protruded on the recording sheet S side more than the carriage 3, in the carriage 3.

Figure 12:
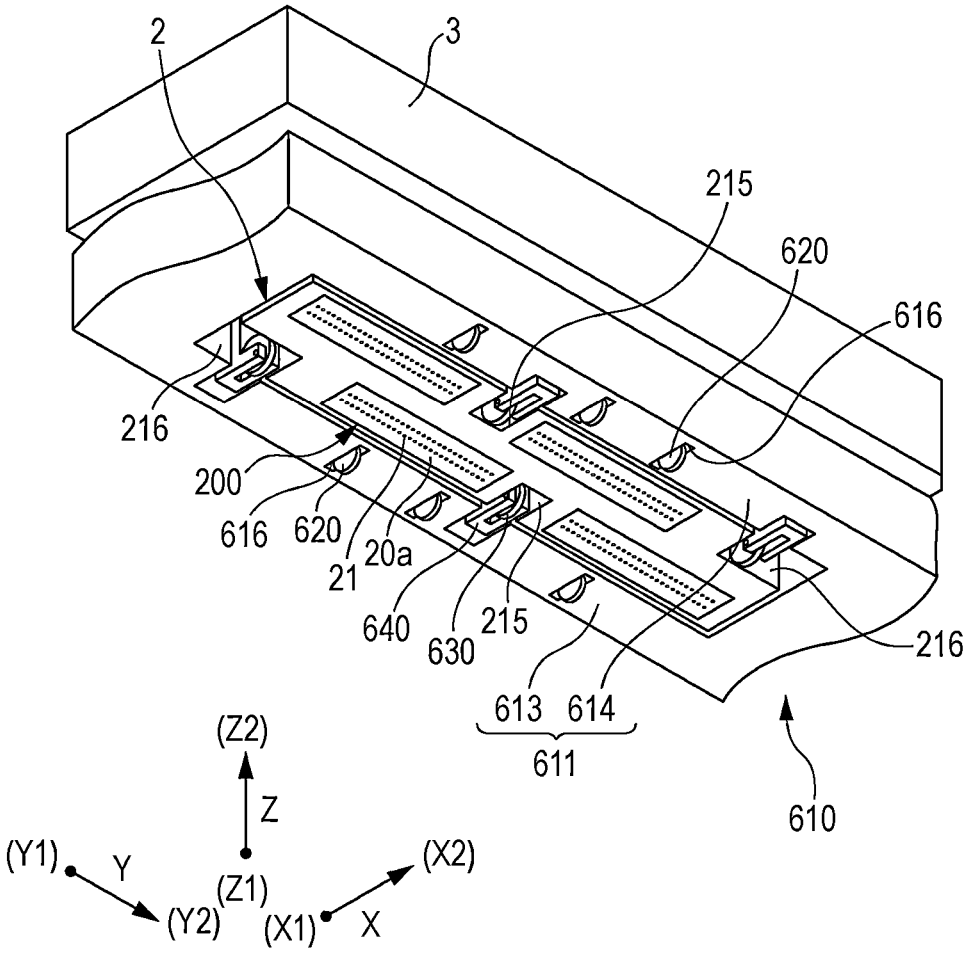
FIG. 12 is a perspective view of the head unit and a roller unit according to Embodiment 1.
Figure 13:
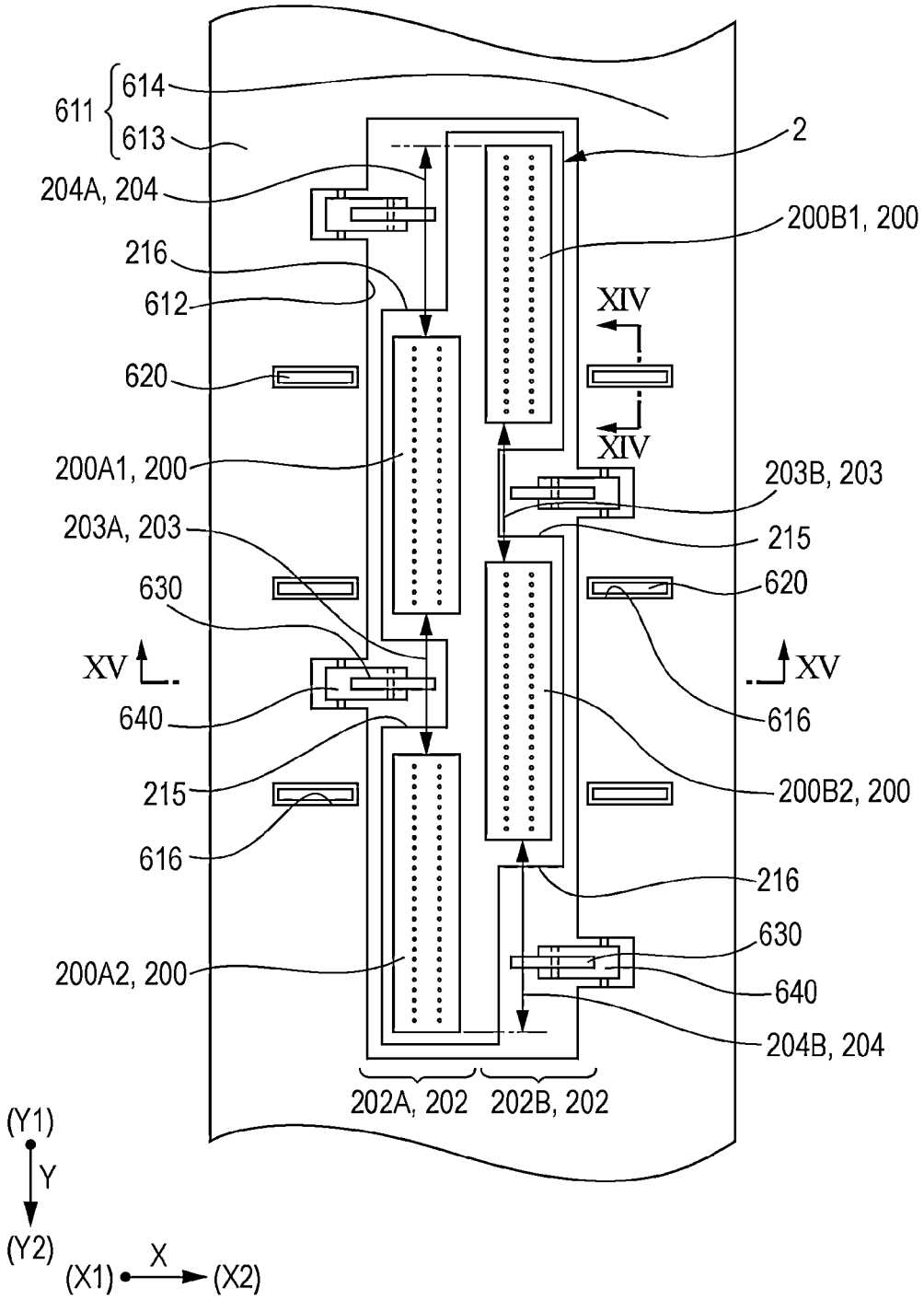
FIG. 13 is a plan view of the head unit and the roller unit according to Embodiment 1.
Figure 14:
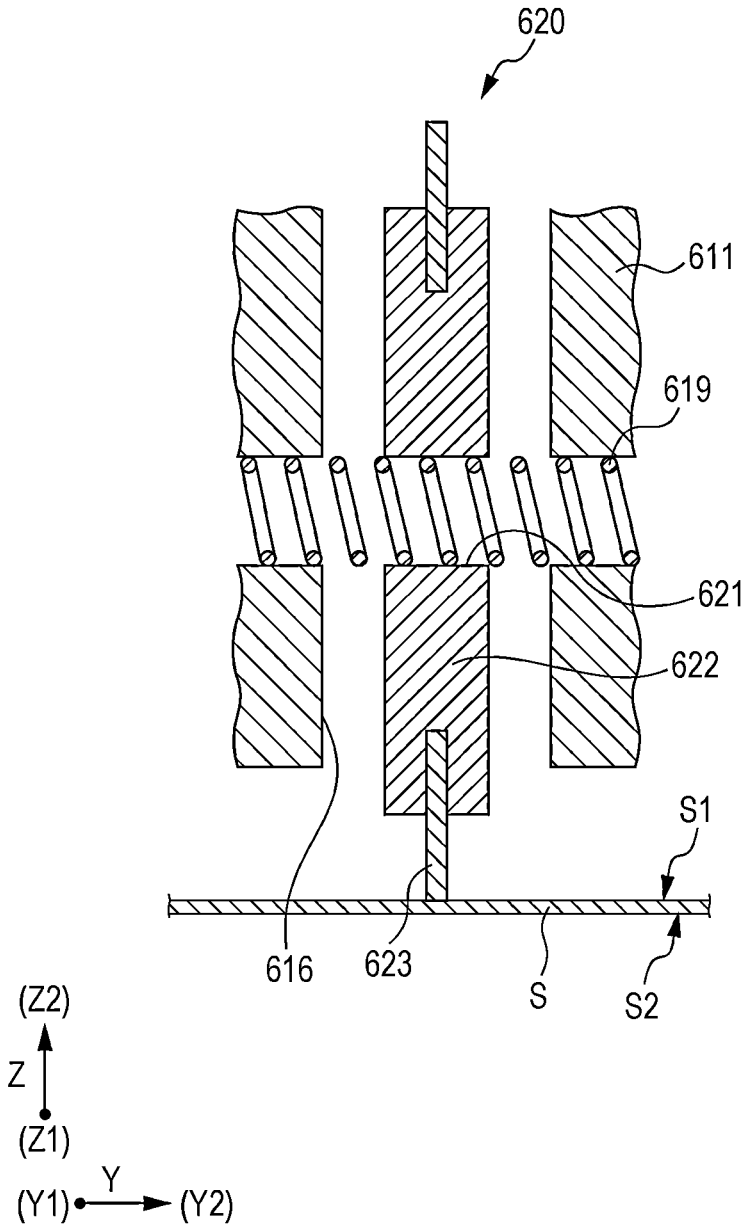
FIG. 14 is a cross-sectional view of the head unit and the roller unit according to Embodiment 1.
Figure 15:
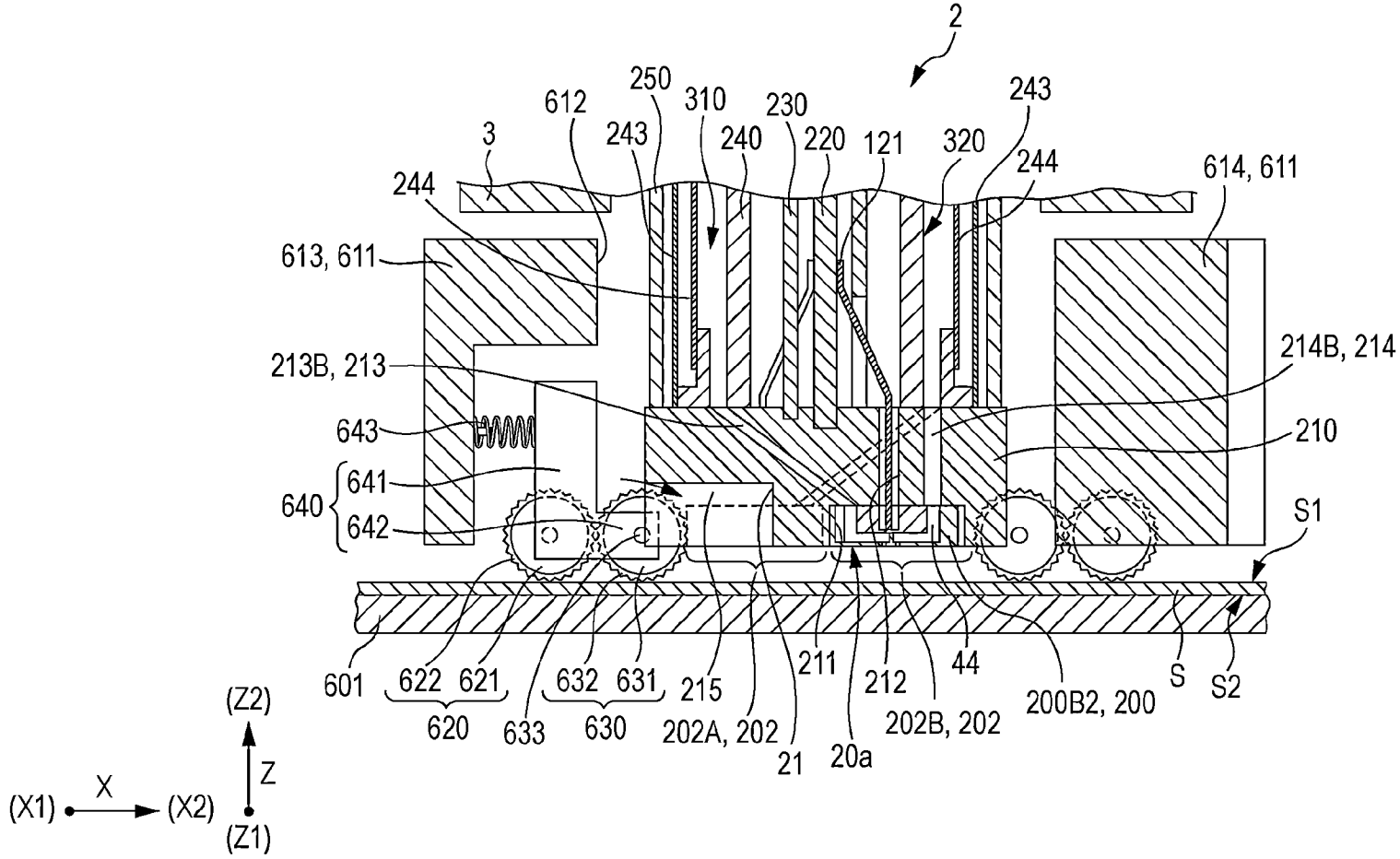
FIG. 15 is a cross-sectional view of the head unit and the roller unit according to Embodiment 1.

Here, the roller unit 610 of the ink jet type recording apparatus 1 will be described with reference to FIGS. 1 to 2B, and FIGS. 12 to 16. In addition, FIG. 12 is a perspective view of the ink jet type recording head unit and the roller unit. FIG. 13 is a plan view of the ink jet type recording head unit and the roller unit when viewed from the liquid ejecting surface side. In addition, FIG. 14 is a cross-sectional view along line XIV-XIV in FIG. 13, and FIG. 15 is a cross-sectional view along line XV-XV in FIG. 13.

The roller unit 610 includes a frame 611 which is fixed to the apparatus main body 7, and an out-head roller 620 and the in-head rollers 630 which are provided in the frame 611.

The frame 611 is disposed between the carriage 3 and the S1 of the recording sheet S, and includes an opening portion 612 into which the liquid ejecting surface 20*a* side of the head unit 2 can be inserted. In other words, when viewed from the third direction Z, the frame 611 has a circular structure which surrounds the head unit 2. In the embodiment, the frame 611 includes a first frame portion 613 provided on the X1 side of the first direction X more than the head unit 2, and a second frame portion 614 provided on the X2 side, and the first frame portion 613 and the second frame portion 614 are provided to be continuous in both end portions in the second direction Y. Accordingly, the opening portion 612 is formed between the first frame portion 613 and the second frame portion 614. In addition, the structure of the frame 611 is not limited to the circular structure, and for example, the first frame portion 613 and the second frame portion 614 may be provided separately. However, similarly to the embodiment, as the frame 611 which has the circular structure is provided, it is possible to improve rigidity of the frame 611.

In the first frame portion 613 and the second frame portion 614, the out-head roller 620 and the in-head roller 630 are provided. As illustrated in FIG. 14, the out-head roller 620 is pivotally supported by a spring 619 which is the second bias unit of which both ends are fixed to the frame 611. Specifically, the out-head roller 620 includes a base portion 622 which is provided with a spring insertion hole 621 through which the spring 619 is inserted, and a roller portion 623 which is provided along a circumferential direction on an outer circumference of the base portion 622. On an outer circumference of the roller portion 623, concavity and convexity are provided to be repeated along the circumferential direction. In other words, the out-head roller 620 of the embodiment is a so-called star wheel. The out-head roller 620 is not limited to the star wheel, and may be a rubber roller or the like. Inside an out-head roller holding portion 616 which has a recessed shape which is opened on a surface on the Z1 side of the frame 611, the out-head roller 620 is accommodated in a state where at least a part of the roller portion 623 is protruded to recording sheet S side more than the surface on the Z1 side of the frame 611.

The out-head roller 620 is disposed on an outer side of the head unit 2, in the first direction X which is the transporting direction of the recording sheet S. In other words, in a plan view from the third direction Z, the out-head roller 620 is disposed at a position which is overlapped with at least the liquid ejecting surface 20*a* of the head unit 2.

In the embodiment, the out-head rollers 620 are respectively provided one by one between the first accommodation portion 215 and the second accommodation portion 216, between the two first accommodation portions 215, and between the second accommodation portion 216 and the first accommodation portion 215, toward the Y2 side from the Y1 side in the second direction Y. In other words, three out-head rollers 620 are provided in each of the first frame portion 613 and the second frame portion 614.

As illustrated in FIG. 15, the in-head roller 630 is held by an arm 640 which is pivotally supported to be rotatable by the frame 611. The arm 640 includes a first arm portion 641 which extends in the third direction Z, and a second arm portion 642 which is provided to be continuous at an end portion on the Z1 side of the first arm portion 641 and extends in the first direction X. An end portion on a side opposite to an end portion which is continuous to the first arm portion 641, of the second arm portion 642, is provided to be protruded to the inside of the opening portion 612 of the frame 611. The in-head roller 630 is pivotally supported to be rotatable by a rotation axis 633 in the end portion of the second arm portion 642 which is protruded to the inside of the opening portion 612. Here, similarly to the out-head roller 620, the in-head roller 630 includes a base portion 631 and a roller portion 632, and concavity and convexity are formed to be repeated in the circumferential direction on an outer circumference of the roller portion 632. In other words, the in-head roller 630 of the embodiment is the so-called star wheel. The in-head roller 630 is not limited to the star wheel, and may be the rubber roller or the like.

In the arm 640, which pivotally supports the in-head roller 630, an end portion on the Z1 side of the first arm portion 641 is pivotally supported to be rotatable by the frame 611. In addition, between an end portion on the Z2 side of the first arm portion 641 and the frame 611, an arm bias spring 643, which is the first bias unit which biases the end portion on the Z2 side of the first arm portion 641 in the first direction X, is provided. Since the arm 640 is provided to be rotatable, as the arm 640 is biased by the arm bias spring 643 in the first direction X, the arm 640 biases the in-head roller 630 which is provided at the end portion of the second arm portion 642 in the third direction Z toward the recording sheet S side. In other words, a direction in which the arm bias spring 643 biases the arm 640 is a direction which is different from the third direction Z which is a direction orthogonal to the landing surface S1. The biasing direction of the arm bias spring 643 is not particularly limited thereto if the direction is different from the third direction Z, and may be the second direction Y, and in addition, may be any direction among the inner surface directions which includes the first direction X and the second direction Y. In addition, the arm bias spring 643 may perform biasing in an inclined direction which includes a component of the third direction Z and components of the first direction X and the second direction Y. Since the in-head roller 630 is biased via the arm 640, compared to a case where the in-head roller 630 is biased by the same structure as that of the out-head roller 620, it is possible to reduce the size of the roller unit 610 in the third direction Z inside the first accommodation portion 215 and the second accommodation portion 216. Therefore, it is possible to reduce the size of the head unit 2 in the third direction Z, and to dispose the head unit 2 to be close to the landing surface S1 of the recording sheet S. In addition, since the out-head roller 620 is directly biased in the third direction Z, not via the arm 640 unlike the in-head roller 630, it is possible to reduce the number of components and the cost. In addition, as the arm 640 is provided in the out-head roller 620, the space which is provided with the arm 640 in the first frame portion 613 and the second frame portion 614 is not necessary, and by reducing the width of the first frame portion 613 and the second frame portion 614 in the first direction X, it is possible to narrow an interval between the two out-head rollers 620 which are disposed to nip the head unit 2 in the first direction X, and to stably hold the recording sheet S between the two out-head rollers 620.

The in-head roller 630 is provided one by one in the first frame portion 613 and the second frame portion 614 with respect to each of the void 203 and the interval 204 of the head unit 2. In other words, two in-head rollers 630 are provided in the first frame portion 613, and two in-head rollers 630 are provided in the second frame portion 614. The in-head roller 630 is provided to be protruded to the inside of the opening portion 612 by the arm 640. Therefore, in the in-head roller 630, at least a part of the in-head roller 630 is provided to face the void 203 and the interval 204 of the head unit 2 in the third direction Z. In addition, a case where at least a part of the in-head roller 630 and the head unit 2 face each other in the third direction Z means a case where at least a part of the in-head roller 630 is overlapped with the head unit 2 when the in-head roller 630 is projected to the head unit 2 in the third direction Z. In addition, a case where the in-head roller 630 is overlapped with the head unit 2 means a case where the in-head roller 630 is overlapped with a surface on the liquid ejecting surface 20*a* side of the head unit 2. In other words, on the Z2 side of the head unit 2, even when the head unit 2 extends to face the out-head roller 620 in the third direction Z, the out-head roller 620 does not face the head unit 2 in the third direction Z. In addition, in the embodiment, the in-head roller 630 is provided so that the rotation axis 633 faces the head unit 2 in the third direction Z. In addition, at least a part of the in-head roller 630 and a part of the out-head roller 620 are provided to face each other in the axial direction of the rotation axis 633, that is, in the second direction Y. Accordingly, it is possible to narrow the width of the first frame portion 613 and the second frame portion 614 in the first direction X, and to reduce the size of the ink jet type recording apparatus 1. The in-head roller 630 is not particularly limited thereto, and the in-head roller 630 may be disposed at a position where the rotation axis 633 does not face the head unit 2 in the third direction Z. In addition, the in-head roller 630 may not be provided at a position where the in-head roller 630 and the out-head roller 620 face each other.

In this manner, as at least a part of the in-head roller 630 is provided to face the head unit 2 in the third direction Z, it is possible to narrow the interval between the two in-head rollers 630 which are provided on both sides of the head unit 2 in the first direction X which is the transporting direction. Therefore, it is possible to shorten the distance by which the recording sheet S is pressed by the in-head roller 630 on both sides of the head unit 2 in the first direction X. In other words, when only the out-head roller 620 is provided without the in-head roller 630, since the out-head roller 620 is provided in a region at which the out-head roller 620 does not face the head unit 2 in the third direction Z, the distance by which the out-head roller 620 presses the recording sheet S in the first direction X becomes wider than the width of the head unit 2 in the first direction X. In contrast, in the embodiment, on both sides of the head unit 2 in the first direction X, since the recording sheet S is pressed by the in-head roller 630 which is disposed on the head unit 2 side more than the out-head roller 620, the interval between the in-head rollers 630 becomes narrower than the head unit 2 in the first direction X. Therefore, it is possible to shorten the interval between the in-head rollers 630 on both sides of the head unit 2 in the first direction X, and to prevent the recording sheet S held between the in-head rollers 630 from lifting up. In the first direction X, on the landing surface S1 of the recording sheet S, since the ink lands between the two in-head rollers 630, the recording sheet S between the in-head rollers 630 is prevented from lifting up, and accordingly, it is possible to prevent the landing position of the ink on the recording sheet S from being shifted. In addition, in the embodiment, as the rotation axis 633 of the in-head roller 630 is provided to face the head unit 2 in the third direction Z, it is possible to further shorten the distance between the in-head rollers 630 which press the recording sheet S on both sides of the head unit 2 in the first direction X, and further, to stabilize the posture of the recording sheet S. Even when the in-head roller 630 is disposed on an outer side of the region where the rotation axis 633 faces the head unit 2 in the third direction Z, compared to the out-head roller 620, it is possible to shorten the distance between the in-head rollers 630 in the first direction X.

In addition, in the embodiment, as the out-head roller 620 is provided in the second direction Y between the in-head rollers 630 which are adjacent to each other, it is possible to press the recording sheet S by the out-head roller 620 and the in-head roller 630 with a narrow interval in the second direction Y. Therefore, compared to a case where only the in-head roller 630 is provided, it is possible to prevent the recording sheet S from lifting up between the in-head rollers 630 which are adjacent to each other in the second direction Y, and to prevent the landing position of the ink on the recording sheet S from being shifted.

In addition, in the embodiment, the first accommodation portion 215 is provided in the void 203 of the holder 210, and the second accommodation portion 216 is provided in the interval 204. For this reason, at least a part of the in-head roller 630 of the embodiment is accommodated inside the first accommodation portion 215 and the second accommodation portion 216. In other words, when viewed from the second direction Y, at least a part of the in-head roller 630 is disposed at an overlapped position inside the first accommodation portion 215 or at an overlapped position inside the second accommodation portion 216. In this manner, as at least a part of the in-head roller 630 is accommodated inside the first accommodation portion 215 and the second accommodation portion 216, it is possible to dispose the liquid ejecting surface 20*a* of the head unit 2 to be close to the landing surface S1 of the recording sheet S. Therefore, it is possible to perform fast printing by preventing the landing position of the ink ejected from the head unit 2 from being shifted. In other words, when the in-head roller 630 is not accommodated inside the first accommodation portion 215 and the second accommodation portion 216, and is disposed on the outside, it is required that the head unit 2 is disposed to be apart from the recording sheet S in the third direction Z in order to make the in-head roller 630 face the head unit 2 in the third direction Z. For this reason, the liquid ejecting surface 20*a* of the head unit 2 and the landing surface S1 of the recording sheet S are apart from each other, the landing position of the ink is shifted, and it is not possible to perform fast printing.

In addition, as described above, the first accommodation portion 215 which accommodates at least a part of the in-head roller 630 can form the first connecting flow path 213 to be inclined with respect to the third direction Z. Therefore, in the third direction Z, the in-head roller 630 is provided between a part on a side which is connected to the flow path 300 of the first connecting flow path 213 and the liquid ejecting surface 20*a* of the head unit 2. In this manner, since the first connecting flow path 213 and the second connecting flow path 214 are formed in the holder 210, compared to a case where the first connecting flow path 213 and the second connecting flow path 214 are formed by the tube or the like outside the holder 210, it is possible to protect the first connecting flow path 213 and the second connecting flow path 214 from the out-head roller 620 and the in-head roller 630.

In addition, in the embodiment, the in-head roller 630 is held by the frame 611, and the frame 611 is fixed to the apparatus main body 7 of the ink jet type recording apparatus 1. For this reason, as the carriage 3 which has the head unit 2 mounted thereon ascends in the third direction Z, the in-head roller 630 relatively moves to the outside of the first accommodation portion 215 and the second accommodation portion 216. Therefore, when the maintenance unit 400 performs maintenance of the head unit 2, the in-head roller 630 does not interfere, and it is possible to easily perform maintenance during a short period of time.

Figure 16A:
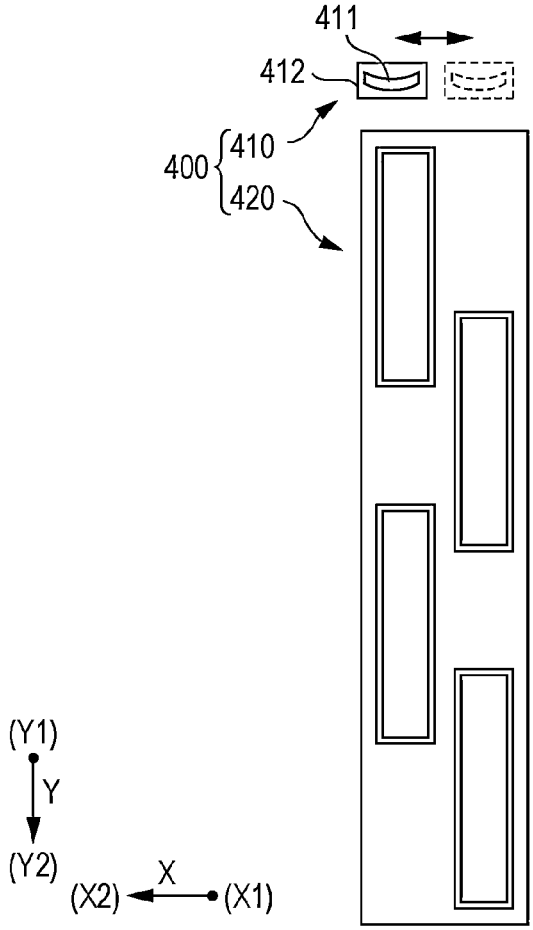
FIGS. 16A and 16B are a plan view and a side view of a maintenance unit according to Embodiment 1.
Figure 16B:
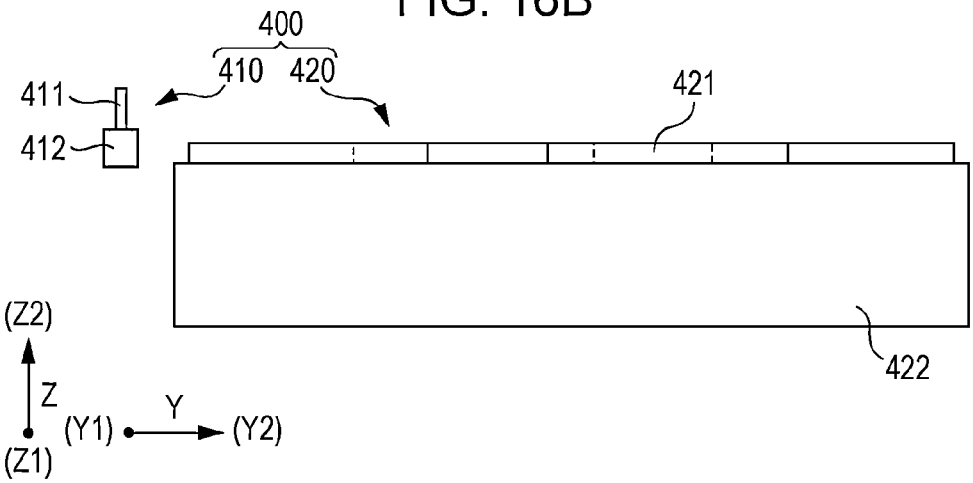
Figure 17A:
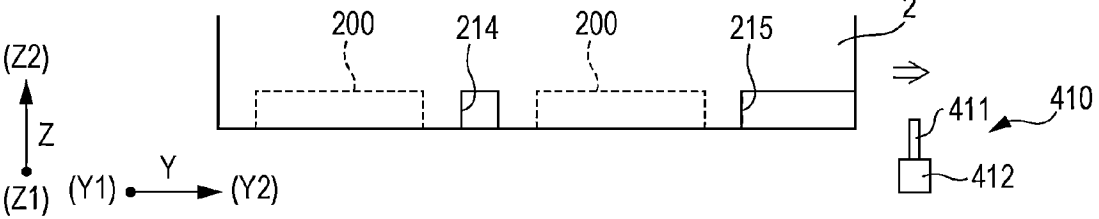
FIGS. 17A to 17C are views illustrating operations of the maintenance unit according to Embodiment 1.
Figure 17B:
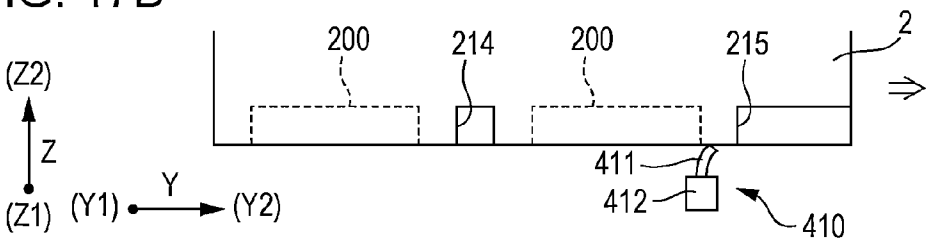
Figure 17C:
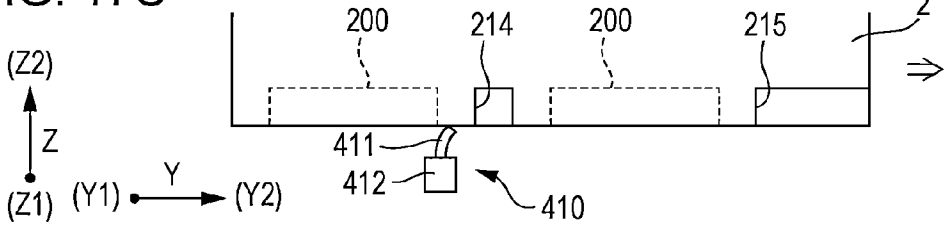

Here, the maintenance unit 400 of the embodiment will be described with reference to FIGS. 16A to 17B. In addition, FIGS. 16A and 16B are a plan view and a side view of the maintenance unit. FIGS. 17A to 17C are views illustrating operations of the maintenance unit.

The maintenance unit 400 includes a wiping unit 410 and a capping unit 420.

The wiping unit 410 includes a blade 411 and a blade holding portion 412 which holds the blade 411.

The blade holding portion 412 is held to be movable to the apparatus main body 7 in the first direction X.

The blade 411 has a shape in which a rectangular parallelepiped having a thin plate shape is curved in a bow shape in one direction, and is formed of an elastic material, such as rubber. Here, a case where the blade 411 is curved in a bow shape means a case where the blade 411 has a curved shape in which a center side is retreated toward the second direction Y compared to both end sides.

Here, as described above, since the carriage 3 which has the head unit 2 mounted thereon and the carriage axis 9 are provided to be able to ascend and descend in the third direction Z and be movable in the second direction Y, as illustrated in FIGS. 17A to 17C, by moving the carriage 3 to a height which makes the blade 411 come into contact with the liquid ejecting surface 20*a* and moving the carriage 3 in the second direction Y, the blade 411 relatively moves in the second direction Y with respect to the liquid ejecting surface 20*a*, and wipes off the liquid ejecting surface 20*a*. In addition, in the embodiment, the blade 411 is formed with a slightly greater width than the width of the liquid ejecting surface 20*a* of each recording head 200 in the first direction X, relatively moves to each head row 202 in the second direction Y, and wipes off the liquid ejecting surface 20*a* of the recording head 200 which constitutes the head row 202. In addition, since the blade holding portion 412 is provided to be movable in the first direction X with respect to the apparatus main body 7, by moving the blade holding portion 412 in the first direction X, it is possible to wipe off the liquid ejecting surfaces 20*a* of the plurality of head rows 202 by one blade 411 in order.

In this manner, in the middle of wiping off the liquid ejecting surface of the recording head 200 of the head row 202 by the blade 411, as illustrated in FIGS. 17A to 17C, without relatively moving the blade 411 and the head unit 2 in the third direction Z, it is possible to wipe off the liquid ejecting surface at one time only by relatively moving the liquid ejecting surfaces 20*a* of the plurality of recording heads 200 in the second direction Y It is possible to realize this as the in-head roller 630 is not accommodated in the first accommodation portion 215 and the second accommodation portion 216, at the maintenance position. In other words, since the frame 611 which holds the in-head roller 630 is fixed to the apparatus main body 7, and the carriage 3 is provided to be able to ascend and descend with respect to the frame 611, only by moving the head unit 2 to the maintenance position, that is, only by making the head unit 2 ascend with respect to the frame 611, it is possible to relatively move the in-head roller 630 which is accommodated in the first accommodation portion 215 and the second accommodation portion 216 to the outside of the first accommodation portion 215 and the second accommodation portion 216.

Therefore, when the liquid ejecting surface 20*a* of the head unit 2 is wiped off by a blade 431, it is possible to prevent the blade 431 from interfering with the in-head roller 630. In contrast, for example, in a case where the in-head roller 630 is pivotally supported by the carriage 3 or the head unit 2 themselves, even when the head unit 2 moves to the maintenance position, since the in-head roller 630 moves at the same time, the in-head roller 630 interferes with the blade 431. For this reason, it is required that the blade 431 moves in a complicated manner, such as making the blade 431 ascend every time each recording head 200 is wiped off. In addition, there is a concern that a splash or the like of the ink when performing wiping-off by the blade 431 is attached to the in-head roller 630, the ink which is attached the in-head roller 630 is attached to the recording sheet S when the recording sheet S is pressed by the in-head roller 630, and the ink contaminates the recording sheet S. In the embodiment, since the in-head roller 630 does not interfere with the blade 431, only by relatively moving the blade 431 in the second direction Y, it is possible to wipe off the liquid ejecting surfaces 20*a* of the plurality of recording heads 200 at one time. Accordingly, moving in a complicated manner is not necessary, and it is possible to perform maintenance during a short period of time. In addition, the splash is unlikely to be attached to the in-head roller 630 when performing wiping-off by the blade 431, and it is possible to suppress contamination of the recording sheet S due to the ink attached to the in-head roller 630.

In addition, in the embodiment, since the frame 611 which holds the out-head roller 620 and the in-head roller 630 is fixed to the apparatus main body 7 and the head unit 2 is able to ascend and descend in the third direction Z, it is possible to adjust the interval between the recording sheet S and the liquid ejecting surface 20*a* of the recording head 200 regardless of the out-head roller 620 and the in-head roller 630. For example, in accordance with the type of the recording sheet S or the type of the ink, even when the interval between the liquid ejecting surface 20*a* and the recording sheet S is adjusted, since positions of the out-head roller 620 and the in-head roller 630 which press the recording sheet S in the third direction Z are not changed, it is possible to reliably hold the recording sheet S and perform printing on the most appropriate condition of the ink and the recording sheet S.

Meanwhile, the capping unit 420 includes a cap 421 which is formed of rubber or the like provided in every recording head 200, and a cap holding portion 422 which holds the plurality of caps 421.

The cap 421 abuts against the liquid ejecting surfaces 20*a* of each recording head 200, and is provided with a size to cover the plurality of entire nozzle openings.

In addition, the cap holding portion 422 holds the plurality of caps 421 on the surface on the Z2 side of the third direction Z, and is provided with a suction path which is not illustrated inside the cap holding portion 422. One end of the suction path communicates with the inside of the cap 421, and the other end of the suction path communicates with a suction device, such as a suction pump. In a state where the liquid ejecting surface 20*a* of the recording head 200 is covered with the cap 421, as the suction device performs a suction operation, the capping unit 420 brings the inside of the cap 421 into a negative pressure state and performs the suction operation by sucking the ink inside the flow path together from the nozzle openings 21 and foreign substances, such as bubbles. In addition, by covering the liquid ejecting surface 20*a* with the cap 421 when printing is not performed, the ink in the vicinity of the nozzle openings 21 may be prevented from drying. Even when the recording head 200 of the head unit 2 is capped by the capping unit 420, when the in-head roller 630 is pivotally supported by the head unit 2 or the carriage 3, the in-head roller 630 interferes with the cap holding portion 422 or the like. For this reason, it is necessary to prepare countermeasures, such as increasing a height of the cap 421 in the third direction Z or forming a recessed portion at a position where the in-head roller 630 interferes with the cap holding portion 422. In the embodiment, at the maintenance position, since the in-head roller 630 is not accommodated inside the first accommodation portion 215 and the second accommodation portion 216 of the head unit 2, it is not required that the capping unit 420 prepares a countermeasure not to interfere with the in-head roller 630, and it is possible to simplify the configuration.

Embodiment 2

Figure 18:
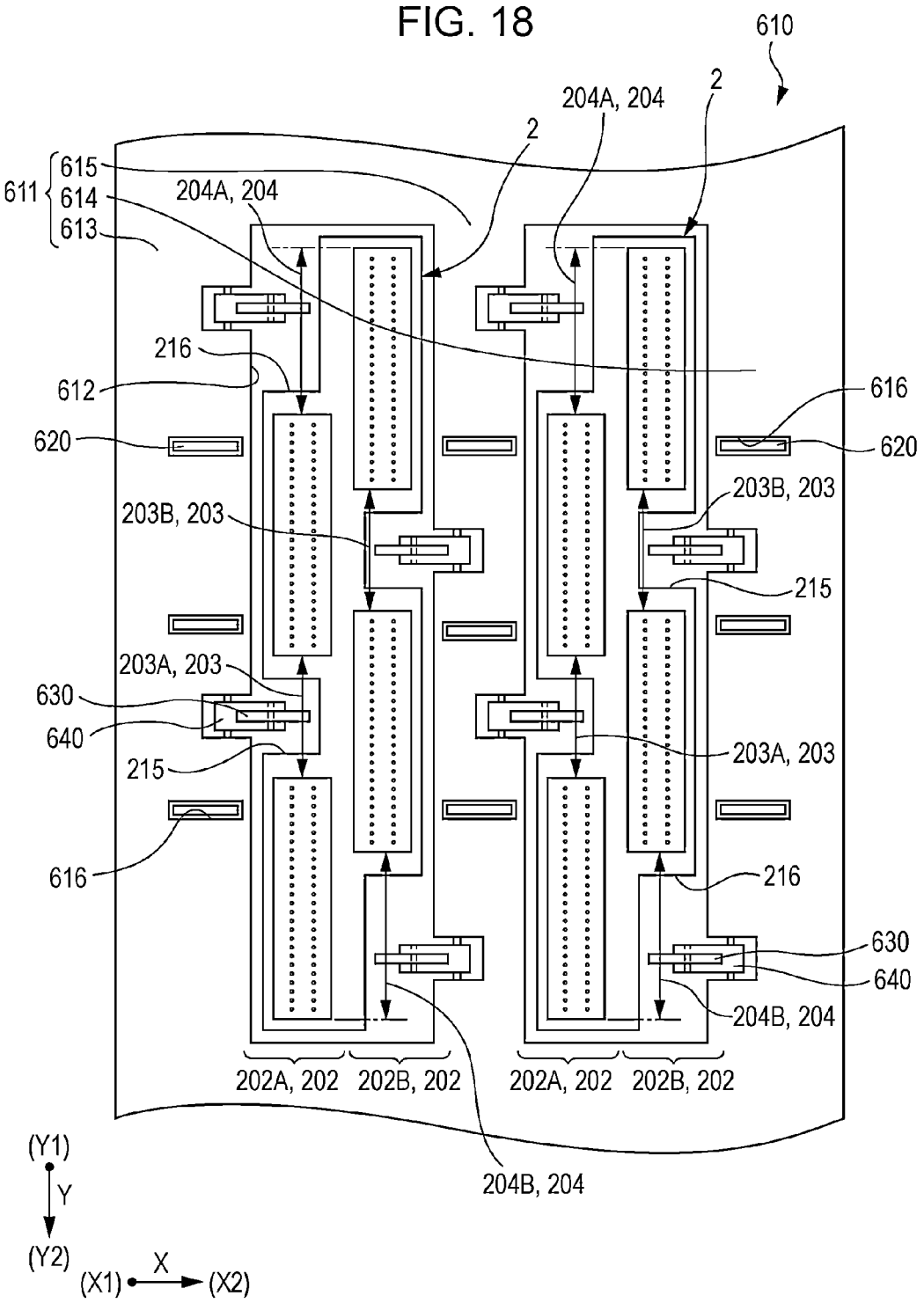
FIG. 18 is a plan view illustrating a connected state of the relay substrate and the wiring substrate according to Embodiment 2.

FIG. 18 is a plan view of the ink jet type recording head and the roller unit according to Embodiment 2 of the invention when viewed from the liquid ejecting surface side. In addition, the members similar to those in above-described Embodiment 1 are given the same reference numerals, and the repeated description will be omitted.

As illustrated in the drawing, in the embodiment, two head units 2 are held by the carriage 3 in the first direction X.

In contrast, the roller unit 610 includes the frame 611, the out-head roller 620, and the in-head roller 630.

The frame 611 is provided with the opening portions 612 in every head unit 2. In other words, in the embodiment, with respect to the two head units 2, the two opening portions 612 are aligned in parallel in the first direction X.

In the first direction X, the frame 611 includes the first frame portion 613 which is disposed on the X1 side more than the head unit 2 provided on the X1 side, the second frame portion 614 which is provided on the X2 side more than the head unit 2 provided on the X2 side, and a beam portion 615 which is provided between the two head units 2.

Similarly to the above-described Embodiment 1, in the first frame portion 613 and the second frame portion 614, the out-head roller 620 and the in-head roller 630 are provided.

In addition, in the beam portion 615, the out-head roller 620, the in-head roller 630 which is protruded to the opening portion 612 on the X1 side, and the in-head roller 630 which is protruded to the opening portion 612 on the X2 side, are provided.

Specifically, in the beam portion 615, toward the Y2 side from the Y1 side of the second direction Y, the out-head rollers 620 are respectively provided between the first accommodation portion 215 and the second accommodation portion 216 of the head unit 2, between the two first accommodation portions 215, and between the second accommodation portion 216 and the first accommodation portion 215. In other words, three out-head rollers 620 are provided in the beam portion.

In addition, in the beam portion 615, the in-head roller 630 of which at least a part is accommodated inside the first accommodation portion 215 and the second accommodation portion 216 which are provided on the X2 side of the head unit 2 on the X1 side, and the in-head roller 630 of which at least a part is accommodated in the first accommodation portion 215 and the second accommodation portion 216 which are provided on the X1 side of the head unit 2 on the X2 side, are provided. In other words, in the beam portion 615, four in-head rollers 630 are provided.

Even when the plurality of head units 2 are provided, similarly to the above-described Embodiment 1, as the in-head rollers 630 which face the head unit 2 in the third direction Z are provided on both sides of the head unit 2 in the first direction X, it is possible to shorten the distance between the in-head rollers 630 provided on both sides of the head unit 2 in the first direction X, to prevent the recording sheet S which is held between the in-head rollers 630 from lifting up, and to prevent the landing position of the ink on the recording sheet S from being shifted.

In addition, in the embodiment, in the second direction Y, as the out-head roller 620 is provided between the in-head rollers 630 which are adjacent to each other, it is possible to press the recording sheet S with a narrow interval in the second direction Y by the out-head roller 620 and the in-head roller 630. Therefore, it is possible to prevent the recording sheet S from lifting up between the in-head rollers 630 which are adjacent to each other in the second direction Y, and to prevent the landing position of the ink on the recording sheet S from being shifted.

In addition, in the embodiment, as at least a part of the in-head roller 630 is accommodated inside the first accommodation portion 215 and the second accommodation portion 216, it is possible to dispose the liquid ejecting surface of the head unit 2 to be close to the landing surface S1 of the recording sheet S. Therefore, it is possible to prevent the landing position of the ink ejected from the head unit 2 from being shifted, and to perform fast printing.

Furthermore, similarly to the above-described Embodiment 1, as the head unit 2 is provided to be able to ascend and descend in the third direction Z with respect to the frame 611 which holds the in-head roller 630, it is possible to prevent the in-head roller 630 from interfering when maintenance of the head unit 2 is performed, and to reduce the maintenance time since the structure which causes the complicated movement is not necessary.

In addition, as the plurality of head units 2 is mounted on the carriage 3, it is possible to discharge different ink from the head unit 2.

Even in the embodiment, at least a part of the in-head roller 630 and a part of the out-head roller 620 are provided to face each other in the axial direction of the rotation axis, that is, in the second direction Y. In particular, as at least a part of the in-head roller 630 and a part of the out-head roller 620 which are provided in the beam portion 615 face each other in the second direction Y, it is possible to narrow a width of the beam portion 615 in the first direction X, and to narrow the interval between the two head units 2 in the first direction X.

Embodiment 3

Figure 19:
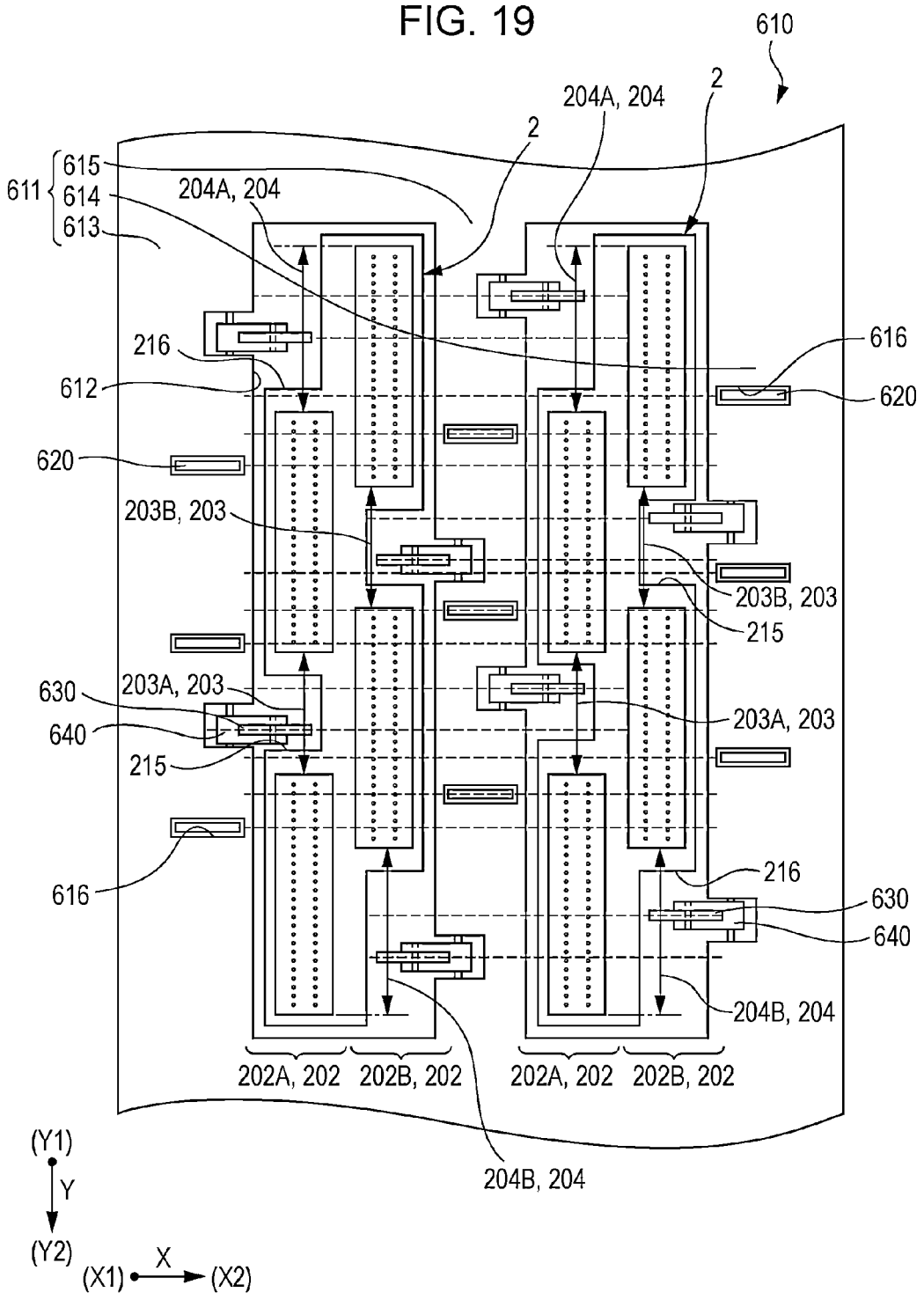
FIG. 19 is a plan view illustrating a connected state of the relay substrate and the wiring substrate according to Embodiment 3.

FIG. 19 is a plan view of the ink jet type recording head and the roller unit according to Embodiment 3 of the invention when viewed from the liquid ejecting surface side. In addition, the members similar to those in above-described embodiments are given the same reference numerals, and the repeated description will be omitted.

As illustrated in the drawing, in the carriage 3, similarly to the above-described Embodiment 2, two head units 2 are mounted.

In addition, the roller unit 610 includes: the frame 611 which has the first frame portion 613, the second frame portion 614, and the beam portion 615; the out-head roller 620; and the in-head roller 630.

All of the out-head rollers 620 and the in-head rollers 630 which are provided with the first frame portion 613, the second frame portion 614, and the beam portion 615, are disposed at a position which is different in the second direction Y. Accordingly, it is possible to prevent the trace of the roller formed on the recording sheet S by the out-head roller 620 and the in-head roller 630 from being formed at the same position from being noticeable. In other words, when the plurality of rollers 620 and 630 presses the position on the recording sheet S in the second direction Y, the trace of the roller becomes noticeable since the trace of the roller remains strong or deep on the recording sheet S as much as the recording sheet S is pressed. However, in the embodiment, the plurality of rollers 620 and 630 does not come into contact with the same position on the recording sheet S in the second direction Y, and comes into contact with a different position. For this reason, it is possible to weakly or shallowly form the trace of the roller, and to make the trace of the roller not noticeable. In addition, when the out-head roller 620 and the in-head roller 630 are the star wheels, the trace of the roller is a recessed trace which is formed on the recording sheet S by compressing the concavity and convexity of the rollers 620 and 630, or a trace which is made as the ink attached to the rollers 620 and 630 is transferred. In addition, even when the out-head roller 620 and the in-head roller 630 are rubber rollers or the like, since the trace of the roller is attached, by shifting the positions of the out-head roller 620 and the in-head roller 630 in the second direction Y, it is possible to suppress the trace of the roller.

Embodiment 4

Figure 20:
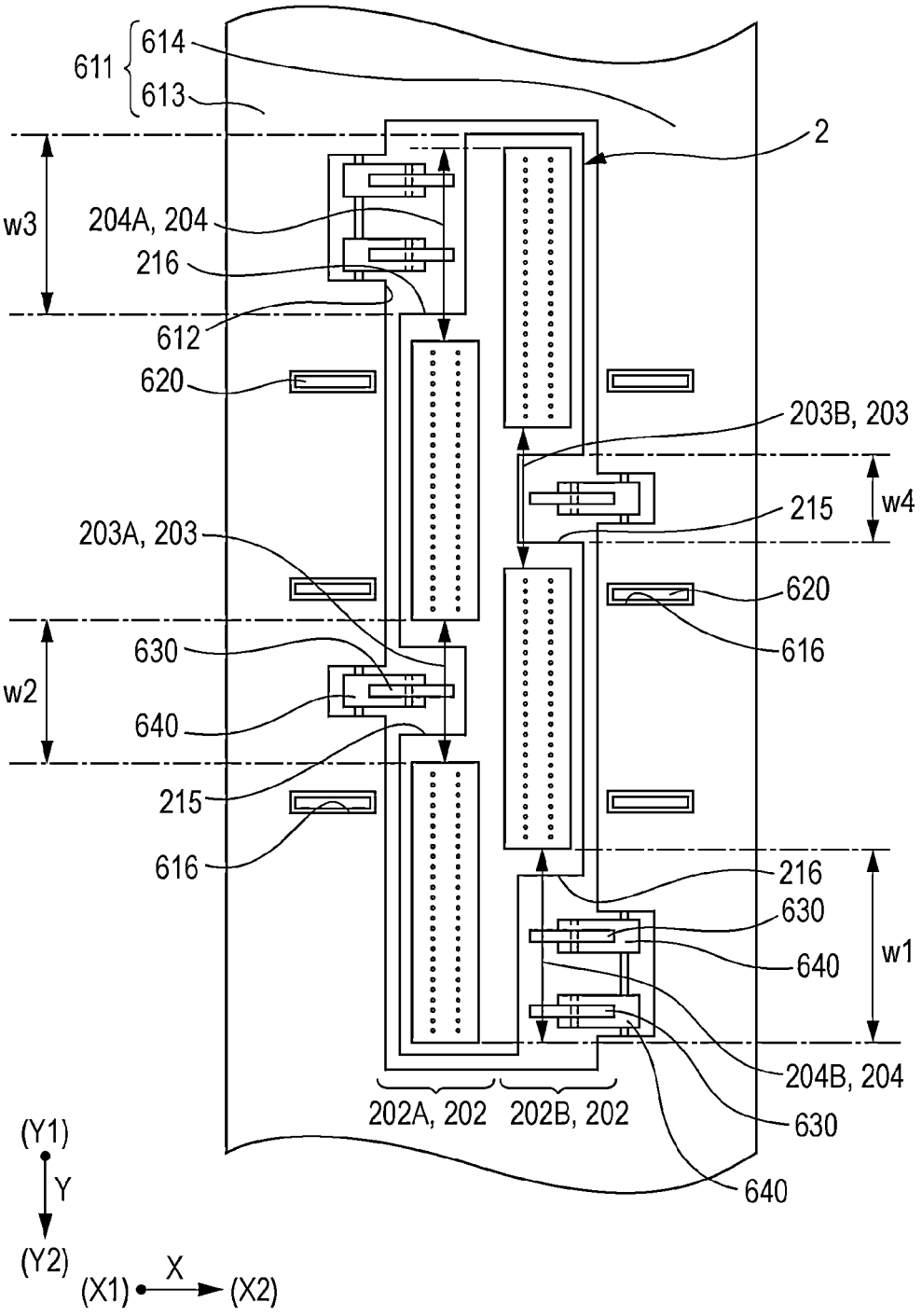
FIG. 20 is a plan view illustrating a connected state of the relay substrate and the wiring substrate according to Embodiment 4.

FIG. 20 is a plan view of the ink jet type recording head and the roller unit according to Embodiment 4 of the invention when viewed from the liquid ejecting surface side. In addition, the members similar to those in above-described embodiments are given the same reference numerals, and the repeated description will be omitted.

As illustrated in the drawing, two head rows 202 are provided in the head unit 2 of the embodiment, and the void 203 and the interval 204 are provided in the head unit 2. In the second direction Y, a width w1 of the interval 204 is formed as a width which is greater than a width w2 of the void 203. As described above, this is because the recording head 200 does not exist on the opposite side where the interval 204 is nipped in the second direction Y since the interval 204 is provided in the end portion of the head row 202.

The first accommodation portion 215 is provided in the void 203, and the second accommodation portion 216 is provided in the interval 204. In the second direction Y, a width w3 of the second accommodation portion 216 is a width which is greater than a width w4 of the first accommodation portion 215. This is because the width w1 of the interval 204 is formed as a width which is greater than the width w2 of the void 203.

One in-head roller 630 is provided with respect to the first accommodation portion 215, and two in-head rollers 630 are provided with respect to the second accommodation portion 216. In other words, one in-head roller 630 is accommodated in the first accommodation portion 215, and two in-head rollers 630 are accommodated in the second accommodation portion 216.

As the plurality of in-head roller 630, in the embodiment, two in-head rollers 630 are provided with respect to the second accommodation portion 216 which has a wide width in the second direction Y, and it is possible to reliably hold the recording sheet S by the in-head roller 630 on an edge portion side of the recording sheet S in the second direction Y. Therefore, it is possible to prevent the edge portion of the recording sheet S in the second direction Y from lifting up.

In addition, the number of the in-head rollers 630 with respect to the second accommodation portion 216 is not particularly limited, and for example, may be three or more. In addition, the number of the in-head rollers 630 which corresponds to one first accommodation portion 215 is not particularly limited, and may be two or more. However, since the second accommodation portion 216 is wider compared to the first accommodation portion 215, it is preferable that the number of the in-head rollers 630 which corresponds to one second accommodation portion 216 is greater than the number of the in-head rollers 630 which corresponds to one first accommodation portion 215.

Embodiment 5

Figure 21:
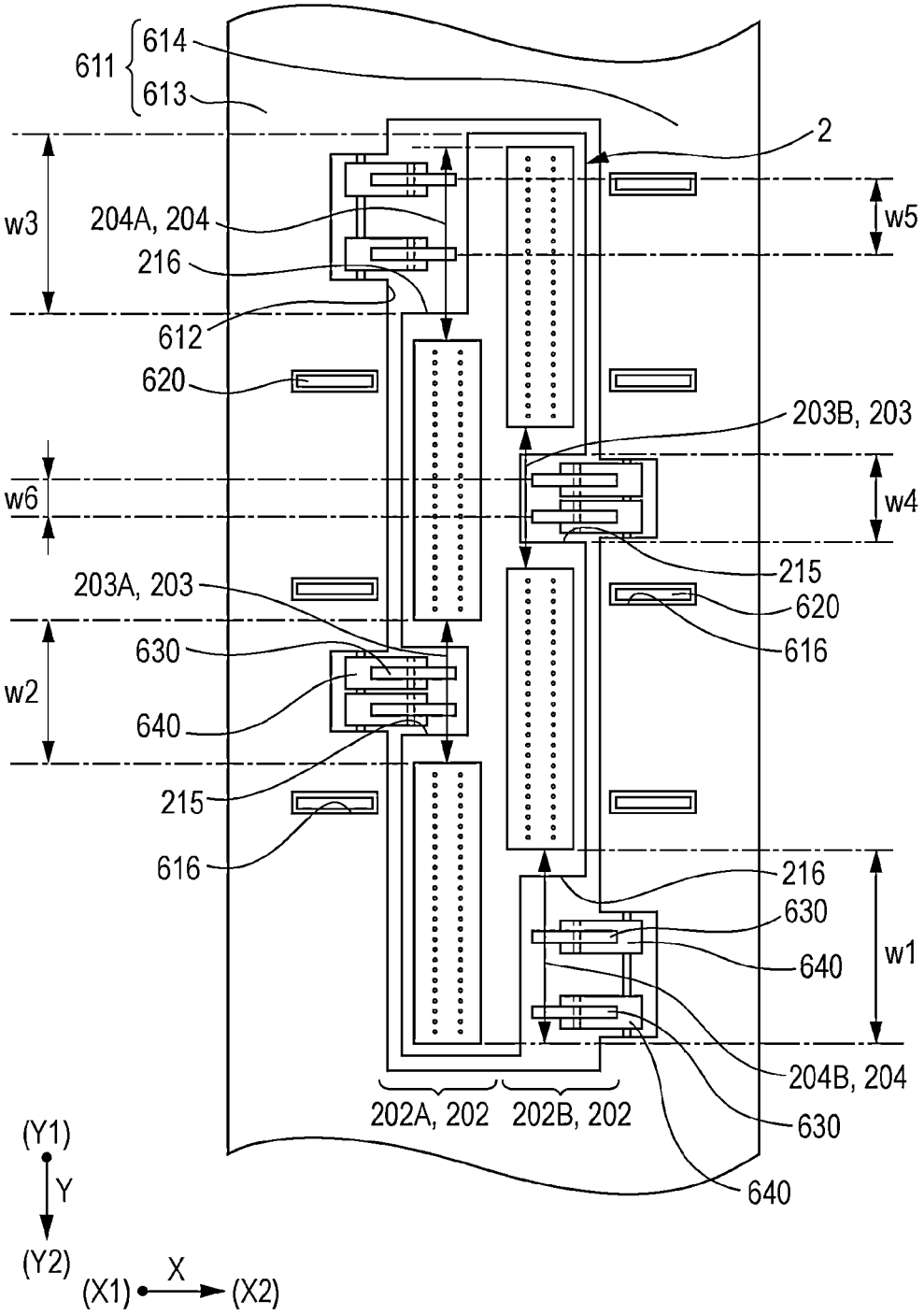
FIG. 21 is a plan view illustrating a connected state of the relay substrate and the wiring substrate according to Embodiment 5.

FIG. 21 is a plan view of the ink jet type recording head and the roller unit according to Embodiment 5 of the invention when viewed from the liquid ejecting surface side. In addition, the members similar to those in above-described embodiments are given the same reference numerals, and the repeated description will be omitted.

As illustrated in the drawing, in the head unit 2, the first accommodation portion 215 and the second accommodation portion 216 are provided, and the width w3 of the second accommodation portion 216 in the second direction Y is formed to be wider than the width w4 of the first accommodation portion 215.

In each of the first accommodation portion 215 and the second accommodation portion 216, two in-head rollers 630 are provided. An interval w5 between the two in-head rollers 630 provided in the second accommodation portion 216 in the second direction Y is wider than an interval w between the two in-head rollers 630 provided in the first accommodation portion 215.

In this manner, as the interval w5 of the two in-head rollers 630 provided corresponding to the second accommodation portion 216 becomes wider, the interval between the traces of the rollers becomes wider, and further, it is possible to make the roller trace noticeable.

OTHER EMBODIMENTS

Above, each embodiment of the invention is described, but a basic configuration of the invention is not limited to the description above.

For example, in each embodiment of the invention, one or two head units 2 are provided in the carriage 3, but the invention is not particularly limited thereto, and for example, three or more head units 2 may be provided in the carriage 3.

In addition, in the above-described Embodiment 1, a configuration in which one type of ink is ejected from one head unit 2 is illustrated as an example, but the invention is not particularly limited thereto, and for example, different types of ink may be ejected from each nozzle row.

Furthermore, in each of the above-described embodiments, the out-head roller 620 and the in-head roller 630 are described as driven rollers which is driven by the transporting belt 601, but the invention is not particularly limited thereto, and the driving motor may be connected to at least one of the out-head roller 620 and the in-head roller 630.

In addition, in each above-described embodiment, the direction of parallel alignment of the recording heads 200 of the head unit 2 is considered as the second direction Y when the recording heads 200 are mounted on the ink jet type recording apparatus 1, but the invention is not particularly limited thereto, and for example, the direction of parallel alignment of the recording heads 200, that is, the direction of parallel alignment of the nozzle openings 21, may be a direction which is inclined with respect to the second direction Y of the ink jet type recording apparatus 1. In other words, the recording heads 200 which constitute the head rows 202 may be aligned in parallel in a direction which is inclined with respect to the axial direction of the carriage axis. Similarly, the direction of parallel alignment of the head rows 202 is considered as the first direction X, but the invention is not limited thereto, and for example, the direction of parallel alignment of the head rows 202 may be a direction which is inclined with respect to the first direction X.

In addition, in each above-described embodiment, the out-head roller 620 is provided, but the invention is not particularly limited thereto, and only the in-head roller 630 may be provided without providing the out-head roller 620. In addition, in each above-described embodiment, the first transporting unit 5 and the second transporting unit 6 are provided in the ink jet type recording apparatus 1, but the invention is not particularly limited thereto, and only the in-head roller 630 may be provided.

In addition, in each of the above-described embodiments, as the pressure generating unit which generates a change in pressure in the pressure generation chamber 12, the thin film type piezoelectric actuator 130 is used in the description, but the invention is not particularly limited thereto, and for example, it is possible to use a thick film type piezoelectric actuator which is formed by a method of adhering a green sheet, or the like, or a longitudinal vibration type piezoelectric actuator which alternately layers a piezoelectric material and an electrode forming material and expands and contracts the materials in the axial direction. In addition, as the pressure generating unit, it is possible to use a unit which disposes a heating element inside the pressure generation chamber and discharges liquid droplets from the nozzle openings by the bubbles generated by heating the heating element, or a unit, which is a so-called electrostatic actuator that generates static electricity between the diaphragm and the electrode, transforms the diaphragm by an electrostatic force, and discharges the liquid droplets from the nozzle openings.

In addition, in the above-described embodiments, the ink jet type recording head unit is described as an example of the liquid ejecting head unit, and the ink jet type recording apparatus is described as an example of the liquid ejecting apparatus. However, the invention is to target a general liquid ejecting head unit and a general liquid ejecting apparatus which have the liquid ejecting head in a broad sense, and can be employed even in the liquid ejecting head unit and the liquid ejecting apparatus which eject the liquid other than the ink. Other examples of the liquid ejecting head includes various types of recording heads which are used in an image recording apparatus, such as a printer, a coloring material ejecting head which is used in a color filter, such as a liquid crystal display, an electrode material ejecting head which is used in forming the electrode, such as an organic EL display or an FED (field emission display), or a bio-organic material ejecting head which is used in manufacturing a bio chip. The invention can be employed even in the liquid ejecting head unit and the liquid ejecting apparatus which are provided with the related liquid ejecting heads.

What is claimed is:

1. A liquid ejecting apparatus for ejection of a liquid on an ejecting medium, comprising:

an apparatus main body;

a liquid ejecting head unit which has a plurality of liquid ejecting heads for ejecting the liquid;

an in-head roller for abutting against a landing surface of the ejecting medium; and a frame which pivotally supports the in-head roller, wherein the liquid ejecting head unit is able to ascend and descend with respect to the frame in a direction which is orthogonal to the landing surface, wherein, in the liquid ejecting head unit, at least two head rows, which are configured of the plurality of liquid ejecting heads aligned in parallel with a void in a reference direction which intersects a transporting direction of the ejecting medium, are formed in the transporting direction, wherein one of the liquid ejecting heads in one of the head rows is disposed at a position where the void of another head row is overlapped in the transporting direction, wherein the in-head roller is disposed at a position where at least a part of the in-head roller is orthogonal to the landing surface as viewed from within the void, wherein the frame is fixed to the apparatus main body.

2. The liquid ejecting apparatus according to claim 1, wherein, in the liquid ejecting head unit, in a region which corresponds to the void of the head rows, a first accommodation portion, which has a recessed shape that is opened to the ejecting medium side, is provided, and wherein at least a part of the in-head roller is accommodated inside the first accommodation portion when the liquid ejecting head unit is at an ejecting position where the liquid is ejected on the ejecting member.

3. The liquid ejecting apparatus according to claim 1, further comprising:

an out-head roller which abuts against the landing surface of the ejecting medium and presses the landing surface, wherein the out-head roller is pivotally supported by the frame, and wherein the out-head roller is disposed on an outer side of the liquid ejecting head unit in the transporting direction.

4. The liquid ejecting apparatus according to claim 3, wherein at least a part of the out-head roller and a part of the in-head roller are disposed to face each other in an axial direction of a rotation axis.

5. The liquid ejecting apparatus according to claim 1, wherein the in-head roller is pivotally supported by an arm which is provided to be rotatable in the frame, wherein the arm biases the in-head roller toward the landing surface side in a direction which is orthogonal to the landing surface as the arm is biased in a direction which is different from the direction which is orthogonal to the landing surface by a first bias unit, and wherein an out-head roller is biased by a second bias member which performs biasing toward the landing surface side in a direction which is orthogonal to the landing surface.

6. The liquid ejecting apparatus according to claim 1, wherein, when viewed from the direction which is orthogonal to the landing surface, the frame has a circular structure which surrounds the liquid ejecting head unit.

7. The liquid ejecting apparatus according to claim 1, wherein the rotation axis of the in-head roller is provided to face the liquid ejecting head unit in the direction which is orthogonal to the landing surface.

8. The liquid ejecting apparatus according to claim 1, wherein the liquid ejecting head includes a wiring substrate having flexibility, wherein the liquid ejecting head unit is provided with a relay substrate to which a plurality of wiring substrates are connected, wherein the relay substrate is disposed so that a direction which includes the direction which is orthogonal to the landing surface and the reference direction becomes a surface direction, wherein the wiring substrate of the liquid ejecting head which is disposed on one side of the transporting direction more than the relay substrate among the plurality of liquid ejecting heads is connected to a first surface on one side of the transporting direction of the relay substrate, wherein the wiring substrate of the liquid ejecting head which is disposed on the other side of the transporting direction more than the relay substrate among the plurality of liquid ejecting heads is connected to a second surface on the other side of the transporting direction of the relay substrate, and wherein connected parts, at which the wiring substrate and the relay substrate of each of the liquid ejecting heads which are adjacent to each other in the transporting direction are connected to each other, are disposed so that some parts are overlapped with each other in the transporting direction.

9. The liquid ejecting apparatus according to claim 1, wherein, in the liquid ejecting head unit, as two head rows are disposed to be shifted from each other in the reference direction, an interval between an end portion of one head row and an end portion of the other head row in the reference direction is wider than the void.

10. The liquid ejecting apparatus according to claim 9, wherein the in-head roller is disposed even at a position where at least a part thereof faces the interval in the direction which is orthogonal to the landing surface.

11. The liquid ejecting apparatus according to claim 10, further comprising:

the plurality of liquid ejecting head units, wherein the in-head roller which is provided corresponding to the interval of each of the liquid ejecting head units is disposed at a different position in the axial direction of the rotation axis.

12. The liquid ejecting apparatus according to claim 11, further comprising:

the plurality of liquid ejecting head units, wherein the in-head roller which is provided corresponding to the void of each of the liquid ejecting head units is disposed at a different position in the axial direction of the rotation axis, and wherein the interval in the direction of the rotation axis of the in-head roller which is provided corresponding to the interval of each of the liquid ejecting head units is wider than the interval in the axial direction of the rotation axis of the in-head roller which is provided corresponding to the void of each of the liquid ejecting head units.

13. The liquid ejecting apparatus according to claim 10, wherein the plurality of in-head rollers is provided to face the one interval, and wherein the number of the in-head rollers which face the one interval is larger than the number of the in-head rollers which face the void.

14. The liquid ejecting apparatus according to claim 10, wherein the plurality of in-head rollers is provided to face the one interval, wherein the plurality of in-head rollers is provided to face the one void, and wherein, in a direction of the rotation axis of the in-head roller, the interval of the plurality of in-head rollers which is provided to face the interval is larger than the interval of the plurality of in-head rollers which is provided to face the void.

15. The liquid ejecting apparatus according to claim 1, further comprising:

the plurality of liquid ejecting head units, wherein the in-head roller which is provided corresponding to the void of each of the liquid ejecting head units is disposed at a different position in an axial direction of the rotation axis.

16. The liquid ejecting apparatus according to claim 1, further comprising a maintenance unit, wherein when the maintenance unit works, the in-head roller is located outside of an accommodation position which is located between the liquid ejecting heads.

17. The liquid ejecting apparatus according to claim 16, wherein for a maintenance unit working, the liquid ejecting head unit is moved to a maintenance position which is outside of a transporting passage of the ejecting medium.

18. The liquid ejecting apparatus according to claim 17, further comprising an axis extending to a direction that is parallel to a direction of the head rows, wherein the liquid ejecting head unit is movable along the axis.

19. The liquid ejecting apparatus according to claim 1, further comprising:

a circular structure made of the frame in a the third direction, wherein the head unit is configured to ascend and descend in a circle defined by the circular structure in the third direction.

* * * * *